US007369124B2

(12) United States Patent
Nakano et al.

(10) Patent No.: US 7,369,124 B2
(45) Date of Patent: May 6, 2008

(54) DISPLAY DEVICE AND METHOD FOR DRIVING THE SAME

(75) Inventors: Taketoshi Nakano, Kanagawa (JP); Ken Inada, Tokyo (JP); Takafumi Kawaguchi, Mie (JP)

(73) Assignee: Sharp Kabushiki Kaisha, Osaka (JP)

( * ) Notice: Subject to any disclaimer, the term of this patent is extended or adjusted under 35 U.S.C. 154(b) by 442 days.

(21) Appl. No.: 10/786,609

(22) Filed: Feb. 26, 2004

(65) Prior Publication Data

US 2004/0179014 A1 Sep. 16, 2004

(30) Foreign Application Priority Data

Feb. 28, 2003 (JP) ..... 2003-053682

(51) Int. Cl.
*G09G 5/00* (2006.01)

(52) U.S. Cl. ..... 345/204; 345/79; 345/89; 345/94; 345/96; 345/98; 345/609; 341/144

(58) Field of Classification Search ..... 345/93–96, 345/87, 89–92, 100, 204, 212, 690–692, 345/53, 54, 55, 58
See application file for complete search history.

(56) References Cited

U.S. PATENT DOCUMENTS 6,075,505 A * 6/2000 Shiba et al. ..... 345/87
6,166,715 A 12/2000 Chang et al.
6,333,729 B1 12/2001 Ha
6,424,328 B1 * 7/2002 Ino et al. ..... 345/87
6,707,441 B1 * 3/2004 Hebiguchi et al. ..... 345/92
6,784,866 B2 * 8/2004 Udo et al. ..... 345/100
6,919,870 B2 * 7/2005 Fukuda ..... 345/90
7,006,071 B2 * 2/2006 Bu ..... 345/100

FOREIGN PATENT DOCUMENTS

| | | |
|---|---|---|
| JP | 04-322216 | 11/1992 |
| JP | 06-138851 | 5/1994 |
| JP | 06-308454 | 11/1997 |
| JP | 2003-058119 | 2/2003 |
| TW | 317 354 | 10/1997 |

* cited by examiner

*Primary Examiner*—Richard A. Hjerpe
*Assistant Examiner*—Jennifer T Nguyen
(74) *Attorney, Agent, or Firm*—Nixon & Vanderhye P.C.

(57) ABSTRACT

A liquid crystal panel (500) is provided with a connection switching circuit (502) for connecting a video signal line driving circuit (300) to a plurality of video signal lines (Ls). The connection switching circuit (502) includes analog switches ($SW_i$) that correspond to the video signal lines (Ls) and one side of each of the analog switches ($SW_i$) is connected to one of the video signal lines (Ls). The video signal lines (Ls) are grouped together into groups of two video signal lines (Ls) that are spaced apart by one video signal line. The groups of video signal lines (Ls) respectively correspond to output terminals ($TS_j$) of the video signal line driving circuit (300). The other sides of the analog switches ($SW_i$) connected to the video signal lines (Ls) of the same group are connected to one another, and connected to one output terminal ($TS_j$). Based on a switching control signal GS, the analog switches ($SW_i$) connect each of the output terminals ($TS_j$) in each horizontal scanning period by time division to the two video signal lines (Ls) of the corresponding group.

6 Claims, 15 Drawing Sheets

ONE HORIZONTAL SCANNING PERIOD

G1

G2

G3

GS

S1
+
−
+
−
d11
d13
d21
d23
d31
d33
d41

S2
−
+
−
+
d12
d14
d22
d24
d32
d34
d42
TIME

ONE HORIZONTAL SCANNING PERIOD

G1

G2

G3

GS

S1
+
−
d11
d15
d21
d25
d31
d35
d41
d45

S2
−
+
d12
d16
d22
d26
d32
d36
d42
d46
TIME

G1
ONE HORIZONTAL SCANNING PERIOD

G2

G3

GSa

GSb

GSc

S1
+
−
d11 d13 d15 d21 d23 d25 d31 d33 d35 d41 d43

S2
−
+
d12 d14 d16 d22 d24 d26 d32 d34 d36 d42 d44
TIME

DISPLAY DEVICE AND METHOD FOR DRIVING THE SAME

CROSS REFERENCE TO RELATED APPLICATIONS

This Non-provisional application claims priority under 35 U.S.C. §119(a) upon Japanese Patent Application No. 2003-053682 titled "DISPLAY DEVICE AND METHOD FOR DRIVING THE SAME," filed on Feb. 28, 2003, the content of which is hereby incorporated by reference.

BACKGROUND OF THE INVENTION

1. Field of the Invention

The present invention relates to display devices that are AC driven, such as active-matrix liquid crystal display devices for example. More specifically, the present invention relates to display devices wherein a multitude of video signal lines for transmitting video signals to a plurality of pixel formation portions for forming an image to be displayed are grouped together to a plurality of video signal line groups, taking a plurality of (for example two) video signal lines as one group, and a video signal is outputted from a driving circuit by time division to each of the video signal line groups.

2. Background of the Invention

In recent years, there have been tremendous advances in achieving a higher level of detail for images displayed on display devices. Therefore, in display devices requiring a plurality of signal lines (column electrodes or row electrodes) corresponding to the resolution of the image to be displayed, as in an active matrix liquid crystal display device for example, the number of signal lines (electrodes) per unit length becomes very large, as the level of detail of the displayed image increases. As a result, when mounting the driving circuit applying signals to those signal lines, the pitch of the connection between the output terminals of the driving circuit and the display panel signal lines (referred to as "connection pitch" below) becomes extremely small. This trend to a narrower connection pitch that is brought about by the increased level of detail of the displayed image is particularly striking in the connection portions between the video signal lines (column electrodes) and their driving circuit (referred to as "column electrode driving circuit," "data line driving circuit" or "video signal line driving circuit") in the case of a color display device in which the neighboring three pixels of R (red), G (green) and B (blue) are taken as display units, as in a color liquid crystal display device.

In order to solve this problem, a liquid crystal display device has been proposed, in which two or more video signal lines (for example the three video signal lines corresponding to three neighboring R, G and B pixels) are grouped together, one output terminal of the video signal line driving circuit is assigned to the plurality of video signal lines constituting each group, and in one horizontal scanning period of the image display, video signals are applied by time division to all video signal lines within each group (see JP H6-138851A, for example).

FIG. 2A schematically shows the configuration of the connection between the video signal lines and the driving circuit thereof (referred to as "video signal line driving circuit" in the following) in an active matrix-type liquid crystal display device using this scheme (referred to as "video signal line time-division driving scheme" in the following). In the example shown in FIG. 2A, two video signal lines Ls each are grouped into one group, and each of the video signal line groups corresponds to one of the output terminals $TS_1$, $TS_2$, $TS_3$, . . . of the video signal line driving circuit 300. One selector switch is disposed between each of the output terminals $TS_1$, $TS_2$, $TS_3$, . . . of the video signal line driving circuit 300 and the two video signal lines of the group corresponding to that output terminal. Each of the selector switches is made of two neighboring analog switches $SW_i$ and $SW_{i+1}$ (i=1, 3, 5, . . . ) of the analog switches $SW_1$, $SW_2$, $SW_3$, . . . that are each provided for one of the video signal lines Ls, and one side of each of the analog switches $SW_1$, $SW_2$, $SW_3$, . . . is connected to one of the video signal lines Ls. The other sides of the two analog switches $SW_i$ and $SW_{i+1}$ constituting each selector switch are connected to one another, and are connected to the output terminal $TS_j$ (j=1, 2, 3 . . . ) of the video signal line driving circuit 300 corresponding to that selector switch. These selector switches may be realized as analog switches by thin-film transistors (TFTs) formed on the liquid crystal panel substrate of the display device, for example.

FIGS. 4A to 4D are timing charts showing the scanning signals G1, G2, G3, . . . in a liquid crystal display device of this video signal line time-division driving scheme and the control signal (referred to below as "switching control signal") GS for the selector switches. Here, when the scanning signal Gk is at high level (H level), the k-th scanning signal line is selected, and when the scanning signal Gk is at low level (L level), the k-th scanning signal line is unselected (k=1, 2, 3, . . . ). Moreover, when the switching control signal GS is at H level, the selector switches connect each of the output terminals $TS_j$ (j=1, 2, 3, . . . ) of the video signal line driving circuit 300 to the left one of the two corresponding video signal lines, and when the switching control signal GS is at L level, the selector switches connect each of the output terminals $TS_j$ (j=1, 2, 3, . . . ) of the video signal line driving circuit 300 to the right one of the two corresponding video signal lines. As shown in FIG. 4D, in this liquid crystal display device, in one horizontal scanning period, that is, in the period during which one scanning signal line is selected, the video signal line connected to each of the output terminals $TS_j$ is switched, and each of the video signals from the video signal line driving circuit are applied to the left one of the two video signal lines constituting one group in the first half of the horizontal scanning period, and to the right one of the two video signal lines in the second half of the horizontal scanning period. Thus, each video signal line Ls is charged with the voltage of the video signal that is outputted from the output terminal $TS_j$ of the video signal line driving circuit 300 while the output terminal $TS_j$ is connected to that video signal line Ls, and that voltage value is written as a pixel value into the pixel formation portion Px corresponding to the intersection between that video signal line and the selected scanning signal line.

In liquid crystal display devices using this video signal line time-division driving scheme, the time that each video signal line is charged is shortened in accordance with the number of video signal lines constituting each group, that is, the number of time divisions due to the selector switches. If m is the number of time divisions, then the charge time of each video signal line is 1/m of that in an ordinary liquid crystal display device not using the video signal line time-division driving scheme (½ in the example shown in FIG. 2). However, by forming, on the liquid crystal panel substrate, selector switches with a time division number of m, it is possible to make the pitch of connection of the output terminals of the video signal line driving circuit and the video signal lines m times that of an ordinary liquid crystal display device. Moreover, with this configuration, if a video signal line driving circuit is used that is made of a plurality of integrated circuit chips (IC chips) to drive one liquid crystal panel, then the number of those chips can be decreased.

The advantages of providing selector switches on the display panel substrate and driving the video signal lines by time division as described above, that is, the advantages of the video signal line time-division driving scheme are widely known, and for this, a plurality of video signal lines that are adjacent like, for example, the three video signal lines transmitting video signals to the three neighboring R (red), G (green) and B (blue) pixels are grouped together. In ordinary liquid crystal display devices, AC driving is performed in order to prevent deterioration of the liquid crystal and to sustain the display quality. A typical AC driving scheme is the so-called dot-inversion driving scheme, in which the polarity of the voltage applied to the liquid crystal layer forming the pixel is inverted at each scanning signal line and at each video signal line (and also inverted at each frame). When the above-described conventional video signal line time-division driving scheme is employed in liquid crystal display devices using this dot-inversion driving scheme, then the number of output terminals of the video signal line driving circuit is reduced, but the power consumption per output of the video signal line driving circuit increases in accordance with the number of time divisions (the number of video signal lines per group). That is to say, if a video signal line time-division driving scheme with m time divisions is applied, then, according to a simple model, the power consumption P per output of the video signal line driving circuit can be expressed by the following equation:

$$P \propto m \cdot f \cdot c \cdot V^2 \quad (1)$$

where, f denotes the frequency, c denotes the load capacitance that is driven by the video signal line driving circuit, and V denotes the driving voltage.

SUMMARY OF THE INVENTION

It is therefore an object of the present invention to present a display device with which the power consumption can be reduced while employing the above-described video signal line time-division driving method, as well as a method for driving the same.

According to one aspect of the present invention, a display device comprises:

a plurality of pixel formation portions for forming an image to be displayed;

a plurality of video signal lines for transmitting a plurality of video signals representing the image to the plurality of pixel formation portions;

a video signal line driving circuit that has a plurality of output terminals respectively corresponding to a plurality of video signal line groups made by grouping the plurality of video signal lines into groups of two or more video signal lines, for outputting by time division from each of the output terminals the video signals to be transmitted by the video signal line group corresponding to that output terminal; and a connection switching circuit for connecting each of the output terminals of the video signal line driving circuit to one of the video signal lines in the corresponding video signal line group, and switching the video signal line to which each of the output terminals is connected within the corresponding video signal line group in accordance with said time division;

wherein each of the plurality of video signal line groups is made of a plurality of video signal lines that are spaced apart by an odd number of video signal lines.

With this configuration, two or more video signal lines that are to be connected by time division to an output terminal of a video signal line driving circuit are grouped together while being spaced apart by an odd number of video signal lines, so that when AC driving is carried out in which the voltage polarity of the driving signals is inverted at each video signal line, the voltage polarity of the video signal lines in the same group stays the same. Therefore, if AC driving is performed in which the voltage polarity of the driving signals is inverted at each video signal line, it is possible to drive the video signal lines by time division without making the switching period of the voltage polarity of the video signals to be outputted from the video signal line driving circuit any shorter. Thus, the video signal lines can be driven by time division without increasing the power consumption, and it becomes possible to reduce the power consumption in comparison to that of the conventional technology for driving the video signal lines by time division.

It is preferable that this display device further comprises:

a plurality of scanning signal lines intersecting with the plurality of video signal lines; and a scanning signal line driving circuit for respectively applying to the plurality of scanning signal lines a plurality of scanning signals for selectively driving the plurality of scanning signal lines;

wherein the plurality of pixel formation portions are arranged in a matrix, in correspondence to the intersections between the plurality of video signal lines and the plurality of scanning signal lines;

wherein each of the pixel formation portions comprises:

a switching element that is turned on and off by a scanning signal applied by the scanning signal line driving circuit to the scanning signal line passing through the corresponding intersection;

a pixel electrode connected via the switching element to the video signal line that passes through the corresponding intersection; and an opposing electrode that is shared by the plurality of pixel formation portions, and that is disposed such that a predetermined capacitance is formed between the opposing electrode and the pixel electrode;

wherein the connection switching circuit connects by time division each of the output terminals of the video signal line driving circuit to the video signal lines within the corresponding video signal line group from the time when one scanning signal line is selected by the scanning signal line driving circuit and until another scanning signal line is selected.

With this configuration, in an active matrix-type liquid crystal display apparatus performing AC driving, in which the voltage polarity of the video signals is inverted at each video signal line, it is possible to drive the video signal lines by time division without making the switching period of the voltage polarity of the video signals to be applied from the video signal line driving circuit any shorter. Therefore, the video signal lines can be driven by time division without increasing the power consumption, and it becomes possible to reduce the power consumption in comparison to that of the conventional technology for driving the video signal lines by time division.

In this display device, it is preferable that the connection switching circuit changes a switching order of the video signal lines to be connected to each of the output terminals of the video signal line driving circuit in accordance with a switching of the scanning signal line selected by the scanning signal line driving circuit.

With this configuration, the order for switching the video signal lines to be connected to each of the output terminals of the video signal line driving circuit is changed in accordance with a switching of the scanning signal line selected by the scanning signal line driving circuit, so that brightness irregularities in the displayed image can be suppressed. Moreover, also when AC driving is performed in which the voltage polarity of the driving signals is inverted at each video signal line, since video signal lines that are spaced apart by an odd number of video signal lines are grouped together, the voltage polarities of the video signal lines of the same group are the same. As a result, even when the switching order of the video signal lines to be connected to each of the output terminals is changed, the switching period of the voltage polarity of the video signals to be outputted from the video signal line driving circuit does not become any shorter. Consequently, brightness irregularities in the displayed image can be suppressed without an increase in power consumption.

In this display device, it is preferable that every time the scanning signal line selected by the scanning signal line driving circuit is switched a predetermined number of times of two or greater, the video signal line driving circuit inverts a voltage polarity of the video signal outputted from each of the output terminals, taking the opposing electrode as reference potential.

With this configuration, even when AC driving is performed in which the voltage polarity of the driving signals is inverted at each video signal line, since video signal lines that are spaced apart by an odd number of video signal lines are grouped together, the voltage polarities of the video signal lines of the same group are the same, and moreover the voltage polarities do not change for at least two horizontal scanning periods (that is, twice the period during which one scanning signal line is selected). Thus, if AC driving is performed in which the voltage polarity of the driving signals is inverted at each video signal line, then it is possible to greatly reduce the power consumption in order to drive the video signal lines in comparison to that of the conventional technology for driving the video signal lines by time division.

According to another aspect of the present invention, a method for driving a display device comprising a plurality of pixel formation portions forming an image to be displayed; a plurality of video signal lines for transmitting a plurality of video signals representing the image to the plurality of pixel formation portions; and a video signal line driving circuit having a plurality of output terminals respectively corresponding to a plurality of video signal line groups made by grouping the plurality of video signal lines into groups of two or more video signal lines; comprises:

a step of outputting, by time division, from each of the output terminals the video signals to be transmitted by the video signal line group corresponding to that output terminal; and a step of connecting each of the output terminals to one of the video signal lines in the corresponding video signal line group, and switching the video signal line to which each of the output terminals is connected within the corresponding video signal line group in accordance with said time division;

wherein each of the plurality of video signal line groups is made of a plurality of video signal lines that are spaced apart by an odd number of video signal lines.

These and other objects, features, aspects and advantages of the present invention will become more apparent from the following detailed description of the present invention when taken in conjunction with the accompanying drawings.

DESCRIPTION OF THE PREFERRED EMBODIMENTS

The following is a description of embodiments of the present invention, with reference to the accompanying drawings.

1.1 Overall Configuration and Operation

Figure 1A:
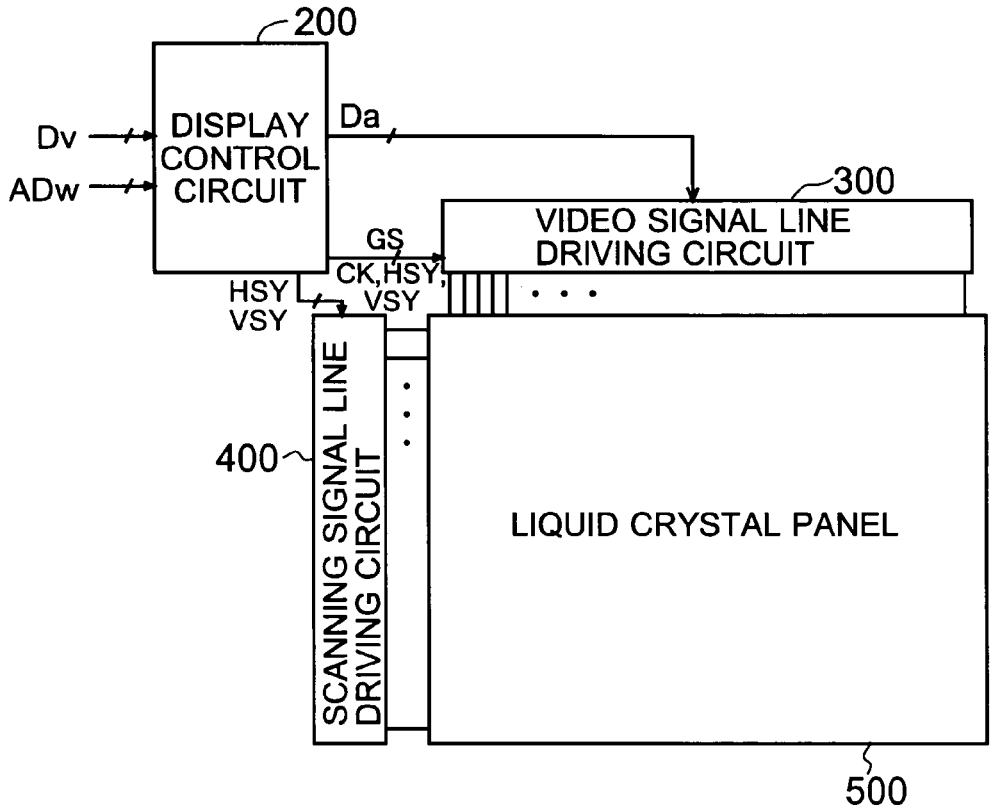
FIG. 1A is a block diagram showing the configuration of a liquid crystal display device according to an embodiment of the present invention.

FIG. 1A is a block diagram showing the configuration of a liquid crystal display device according to an embodiment of the present invention. This liquid crystal display device includes a display control circuit 200, a video signal line driving circuit (also referred to as "column electrode driving circuit") 300, a scanning signal line driving circuit (also referred to as "row electrode driving circuit") 400, and an active matrix-type liquid crystal panel 500.

The liquid crystal panel 500, which serves as the display portion in this liquid crystal display device, comprises a plurality of scanning signal lines (row electrodes), which respectively correspond to the horizontal scanning lines in an image represented by image data Dv received from a CPU of an external computer or the like, a plurality of video signal lines (column electrodes) intersecting with the plurality of scanning signal lines, and a plurality of pixel formation portions that are provided in correspondence to the intersections of the plurality of scanning signal lines and the plurality of video signal lines. The configuration of these pixel formation portions is in principle the same as the configuration of the pixel formation portions in conventional active matrix-type liquid crystal panels (details are discussed below).

In this embodiment, image data (in a narrow sense) representing an image to be displayed on the liquid crystal panel 500 and data determining the timing of the display operation (for example data indicating the frequency of the display clock) (referred to as "display control data" in the following) are sent from the CPU of the external computer or the like to the display control circuit 200 (in the following, the data Dv sent from the outside are referred to as "image data in a broad sense"). That is to say, the external CPU or the like supplies the image data (in the narrow sense) and the display control data, which constitute the image data in a broad sense, as well as address signals ADw to the display control circuit 200, so that the image data (in the narrow sense) and the display control data are respectively written into a display memory and a register (described later) in the display control circuit 200.

Based on the display control data written into the register, the display control circuit 200 generates a display clock signal CK, a horizontal synchronization signal HSY, and a vertical synchronization signal VSY. Moreover, the display control circuit 200 reads out, from the display memory, the image data (in a narrow sense) that has been written into the display memory by the external CPU or the like, and outputs them as digital image signals Da. The display control circuit 200 also generates and outputs a switching control signal GS for time-division driving of the video signal lines and its logically inverted signal GSb (referred to in the following as "inverted switching control signal," or simply "switching control signal" when there is no need to distinguish it from GS). Thus, of the signals generated by the display control circuit 200, the clock signal CK is supplied to the video signal line driving circuit 300, the horizontal synchronization signal HSY and the vertical synchronization signal VSY are supplied to the video signal line driving circuit 300 and to the scanning signal line driving circuit 400, the digital image signals Da are supplied to the video signal line driving circuit 300, and the switching control signals GS and GSb are supplied to the video signal line driving circuit 300 and a (later-described) connection switching circuit inside the liquid crystal panel 500. It should be noted that as the signal lines supplying the digital image signals Da from the display control circuit 200 to the video signal line driving circuit 300, a number of signal lines is provided that corresponds to the gradation number of the displayed image.

As noted above, the data representing the image to be displayed on the liquid crystal panel 500 are supplied serially, pixel for pixel, as the digital image signals Da to the video signal line driving circuit 300, and the clock signal CK, the horizontal synchronization signal HSY, the vertical synchronization signal VSY, and the switching control signal GS are supplied as the signals indicating the timing. Based on the digital image signals Da, the clock signal CK, the horizontal synchronization signal HSY, the vertical synchronization signal VSY, and the switching control signal GS, the video signal line driving circuit 300 generates video signals for driving the liquid crystal panel 500 (referred to as "driving video signals" in the following), and applies these driving video signals to the video signal lines of the liquid crystal panel 500.

Based on the horizontal synchronization signal HSY and the vertical synchronization signal VSY, the scanning signal driving circuit 400 generates scanning signals G1, G2, G3, . . . to be applied to the scanning lines in order to select among the scanning signal lines of the liquid crystal panel 500 one after the other by one horizontal scanning period. The application of the active scanning signal for selecting all of the scanning signal lines one by one is carried out in repetition with one vertical scanning period as the period.

As described above, in the liquid crystal panel 500, the driving video signals $S_1$, $S_2$, $S_3$, . . . are applied to the video signal lines based on the digital image signals Da by the video signal line driving circuit 300, and the scanning signals G1, G2, G3, . . . are applied to the scanning signal lines by the scanning signal driving circuit 400. Thus, the liquid crystal panel 500 displays the image represented by the image data Dv received from the external CPU or the like.

1.2 Display Control Circuit

Figure 1B:
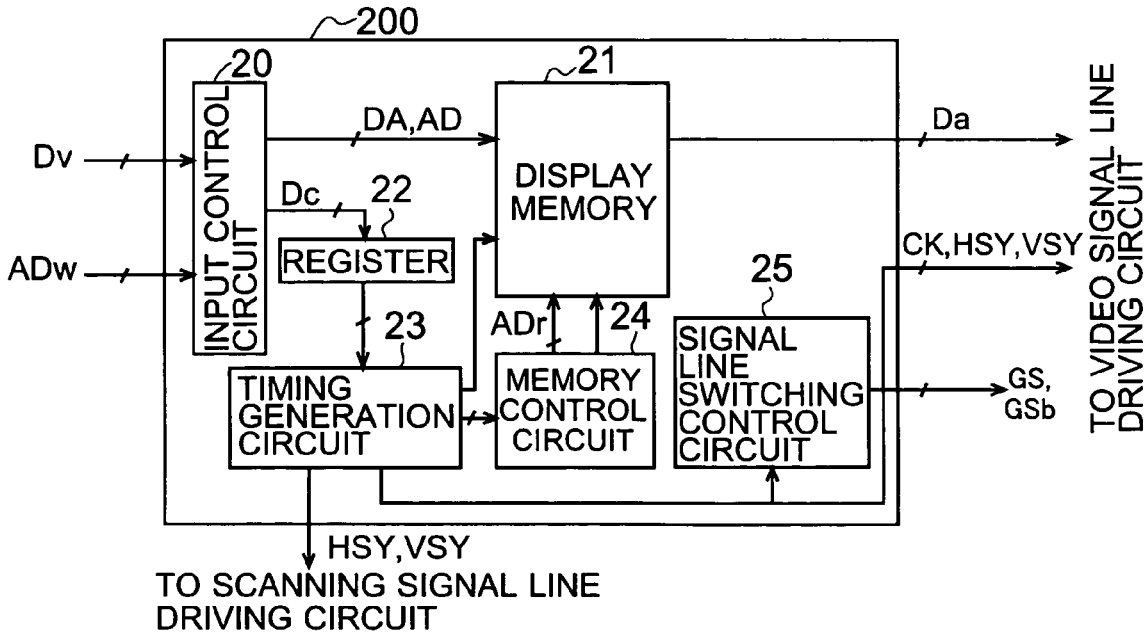
FIG. 1B is a block diagram showing the configuration of the display control circuit of the liquid crystal display device according to this embodiment.

FIG. 1B is a block diagram showing the configuration of the display control circuit 200 in the above-described liquid crystal display device. This display control circuit 200 includes an input control circuit 20, a display memory 21, a register 22, a timing generation circuit 23, a memory control circuit 24, and a signal line switching control circuit 25.

The address signals ADw and signals representing image data Dv in a broad sense (in the following, these signals are also referred to as "Dv") that this display control circuit 200 receives from the external CPU or the like are inputted into the input control circuit 20. Based on the address signals ADw, the input control circuit 20 divides the image data Dv in a broad sense into image data DA and display control data Dc. Then, signals representing the image data DA (in the following these signals are also referred to as "DA") are supplied to the display memory 21 together with address signals AD based on the address signals ADw, so that the image data DA is written into the display memory 21, and the display control data Dc is written into the register 22. The display control data Dc comprises timing information that specifies the frequency of the clock signal CK and the horizontal scanning period and the vertical scanning period for displaying the image represented by the image data Dv.

Based on the display control data held in the register 22, the timing generation circuit 23 generates the clock signal CK, the horizontal synchronization signal HSY and the vertical synchronization signal VSY. Moreover, the timing generation circuit 23 generates a timing signal for operating the display memory 21 and the memory control circuit 24 in synchronization with the clock signal CK.

The memory control circuit 24 generates address signals ADr for reading out, of the image data DA that is inputted from outside and stored in the display memory 21 via the input control circuit 20, the data representing the image to be displayed on the liquid crystal panel 500. The memory control circuit 24 also generates a signal for controlling the operation of the display memory 21. The address signals ADr and the control signal are fed to the display memory 21, and thus, the data representing the image to be displayed on the liquid crystal panel 500 is read out as the digital image signals Da from the display memory 21, and is outputted from the display control circuit 200. As mentioned above, the digital image signals Da are supplied to the video signal line driving circuit 300.

Figures 6A, 6B, 6C, 6D, 6E, 6F:
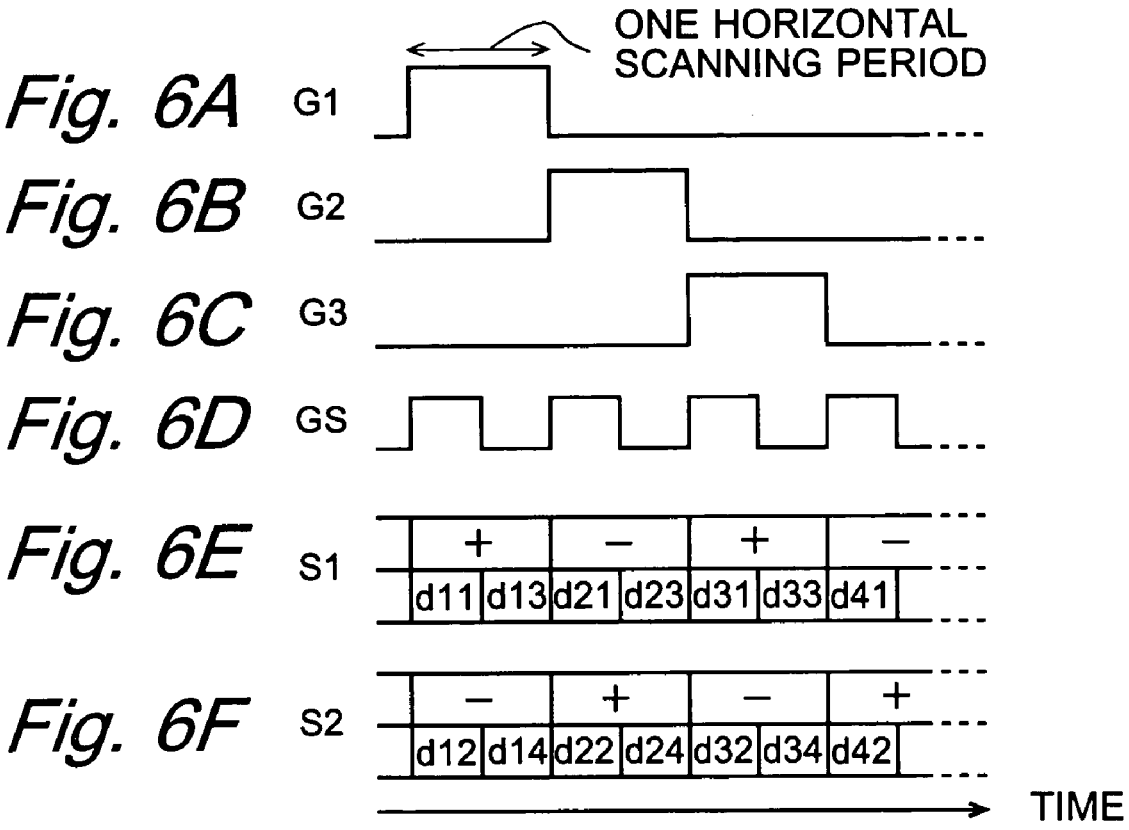
FIGS. 6A to 6F are timing charts illustrating a driving method for the case that the true dot-inversion driving scheme (one-line dot-inversion driving scheme) is employed in the liquid crystal display device provided with the liquid crystal device of this embodiment.

Based on the horizontal synchronization signal HSY and the clock signal CK, the signal line switching control circuit 25 generates the switching control signals GS and GSb for time-division driving of the video signal lines. These switching control signals GS and GSb are control signals for switching, within one horizontal scanning period, the video signal lines to which the video signals outputted from the video signal line driving circuit 300 are to be applied, in order to perform time-division driving of the video signal lines, as described later. As shown in FIG. 6D, a signal that is at H level in the first half of the horizontal scanning period (i.e. the period during which the scanning signals is active) and at L level in the second half is generated as the switching control signal GS, and its logically inverted signal is generated as the switching control inverted signal GSb.

Figure 2A:
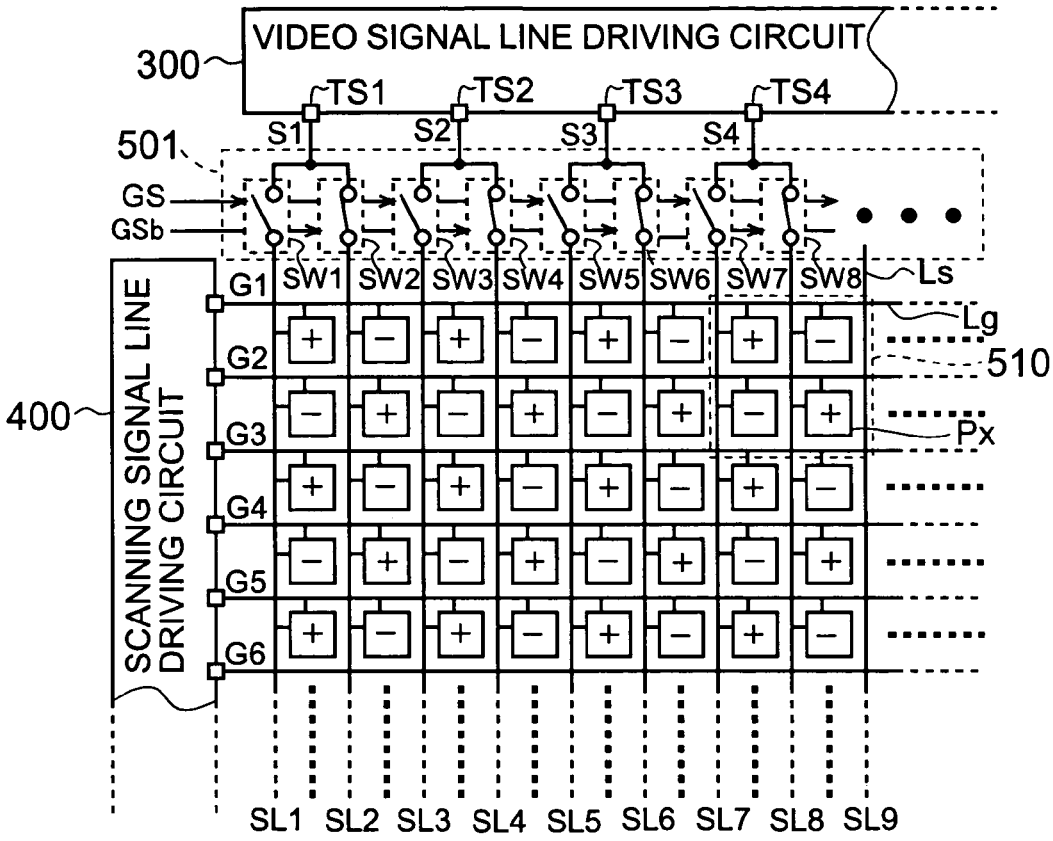
Fig. 2A PRIOR ART
FIG. 2A is a diagrammatic view showing a conventional configuration serving as the basis for the liquid crystal panel in this embodiment (basic conventional configuration).
Figure 2B:
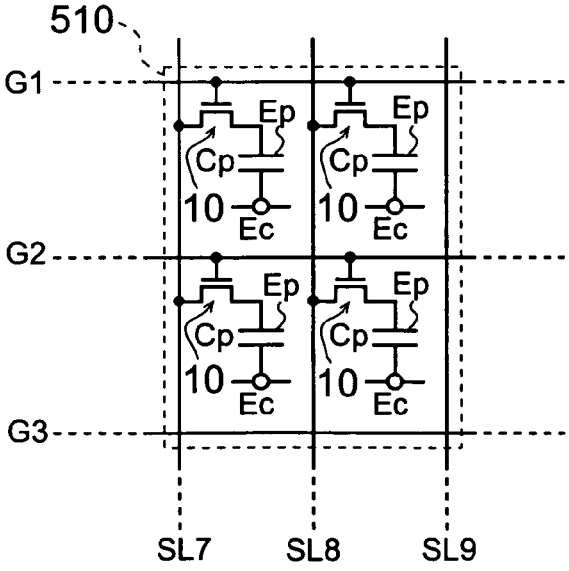
Fig. 2B PRIOR ART
FIG. 2B is an equivalent circuit diagram of a portion (corresponding to four pixels) of the panel of the basic conventional configuration.
Figure 2C:
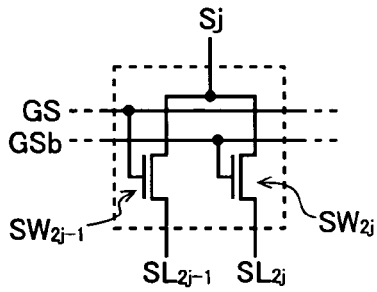
Fig. 2C PRIOR ART
FIG. 2C is an equivalent circuit diagram showing a selector switch constituting a later-described connection switching circuit in the liquid crystal panel of the basic conventional configuration

1.3. Liquid Crystal Panel with Basic Configuration and Method for Driving the Same 1.3.1 Configuration of Liquid Crystal Panel FIG. 2A is a diagrammatic view showing a conventional configuration serving as the basis for the liquid crystal panel 500 in the present embodiment (in the following, this conventional configuration is referred to as "basic conventional configuration"). FIG. 2B is an equivalent circuit diagram of a portion (corresponding to four pixels) 510 of this liquid crystal panel. FIG. 2C is an equivalent circuit diagram showing a selector switch constituting a later-described connection switching circuit 501 in the liquid crystal panel.

The liquid crystal panel of this basic conventional configuration includes a plurality of video signal lines Ls that are connected to the video signal line driving circuit 300 via the connection switching circuit 501, which comprises analog switches $SW_1$, $SW_2$, $SW_3$, . . . , and a plurality of scanning signal lines Lg that are connected to the scanning signal line driving circuit 400. The video signal lines Ls and the scanning signal lines Lg are arranged in a lattice pattern, so that the video signal lines Ls intersect with the scanning signal lines Lg. As noted above, a plurality of pixel formation portions Px are provided in a one-to-one correspondence with the intersections of the video signal lines Ls and the scanning signal lines Lg. As shown in FIG. 2B, each of the pixel formation portions Px is made of a TFT 10 whose source terminal is connected to the video signal line Ls passing through the corresponding intersection, a pixel electrode Ep connected to the drain terminal of that TFT 10, an opposing electrode Ec that is shared by the plurality of pixel formation portions Px, and a liquid crystal layer that is shared by the plurality of pixel formation portions Px and sandwiched between the pixel electrode Ep and the opposing electrode Ec. The pixel electrode Ep and the opposing electrode Ec and the liquid crystal layer sandwiched between them form a pixel capacitance Cp. This configuration of the pixel formation portion Px is the same for all of the embodiments and the modification examples of the present invention as described below.

The pixel formation portions Px are arranged in a matrix, constituting a pixel formation matrix. The pixel electrodes Ep, which are the principal portions of the pixel formation portions Px, correspond one to one to the pixels of the image that is displayed with the liquid crystal panel and can be regarded as the same. Henceforth, to keep the description simple, the pixel formation portions Px and the pixels are regarded as the same, and the "pixel formation matrix" is also referred to as the "pixel matrix."

In FIG. 2A, the "+" marking some of the pixel formation portions Px means that a positive voltage is applied to the pixel liquid crystal constituting the pixel formation portions Px (or, taking the opposing electrode Ec as reference potential, to the pixel electrodes Ep) and the "−" marking some of the pixel formation portions Px means that a negative voltage is applied to the pixel liquid crystal constituting the pixel formation portions Px (or, taking the opposing electrode Ec as reference potential, to the pixel electrodes Ep). The "+" and "−" marking the pixel formation portions Px represent a polarity pattern in the pixel matrix. The method for expressing such a polarity pattern is also the same for all embodiments and the modification examples of the present invention, described below. It should be noted that FIG. 2A illustrates a polarity pattern for the case that the so-called dot-inversion driving scheme is employed, in which the polarity of the voltage applied to the pixel liquid crystal is inverted at each scanning signal line and each video signal line (and also inverted at each frame).

As noted above, as the portion for connecting the video signal lines Ls with the video signal line driving circuit 300, the liquid crystal panel is provided with a connection switching circuit 501 comprising analog switches $SW_1$, $SW_2$, $SW_3$, . . . , respectively corresponding to the video signal lines Ls on the liquid crystal panel (see FIG. 2A). These analog switches $SW_1$, $SW_2$, $SW_3$, . . . are grouped into a plurality of analog switch groups by combining two neighboring analog switches to one analog switch group (the number of analog switch groups is half the number of video signal lines Ls). One side of each of the analog switches $SW_i$ (i=1, 2, 3 . . . ) is connected to the video signal line Ls corresponding to that analog switch $SW_i$, and the other side of that analog switch $SW_i$ is connected to the other side of the other analog switch belonging to the same group as that analog switch $SW_i$, and is connected to one output terminal $TS_j$ (j=1, 2, 3, . . . ) of the video signal line driving circuit 300. Thus, the video signal lines Ls of the liquid crystal panel are paired into a plurality of video signal line groups, and each group of video signal lines (i.e. the two video signal lines Ls constituting each video signal line group) are connected via the two analog switches forming one group to one output terminal $TS_j$ of the video signal line driving circuit 300. Thus, the output terminals $TS_j$ of the video signal line driving circuit 300 are in one-to-one correspondence to the video signal line groups, and each output terminals $TS_j$ is connected via the two analog switches of the same group to one group of video signal lines (i.e. the two video signal lines Ls constituting one video signal line group).

Here, the analog switches $SW_i$ are realized by thin-film transistors (TFTs) that are formed on the liquid crystal panel substrate, for example, and are configured such that the two analog switches $SW_{2j-1}$ and $SW_{2j}$ (j=1, 2, 3 . . . ) forming one group are turned reciprocally on and off in response to the switching control signal GS (and its logically inverted signal GSb) as shown in FIG. 2C. Consequently, the two analog switches $SW_{2j-1}$ and $SW_{2j}$ of each group constitute a selector switch, and connect each output terminal $TS_j$ of the video signal line driving circuit 300 by time division to the two video signal lines of the video signal line group corresponding to that output terminal $TS_j$.

1.3.2 Driving Method

Figure 3:
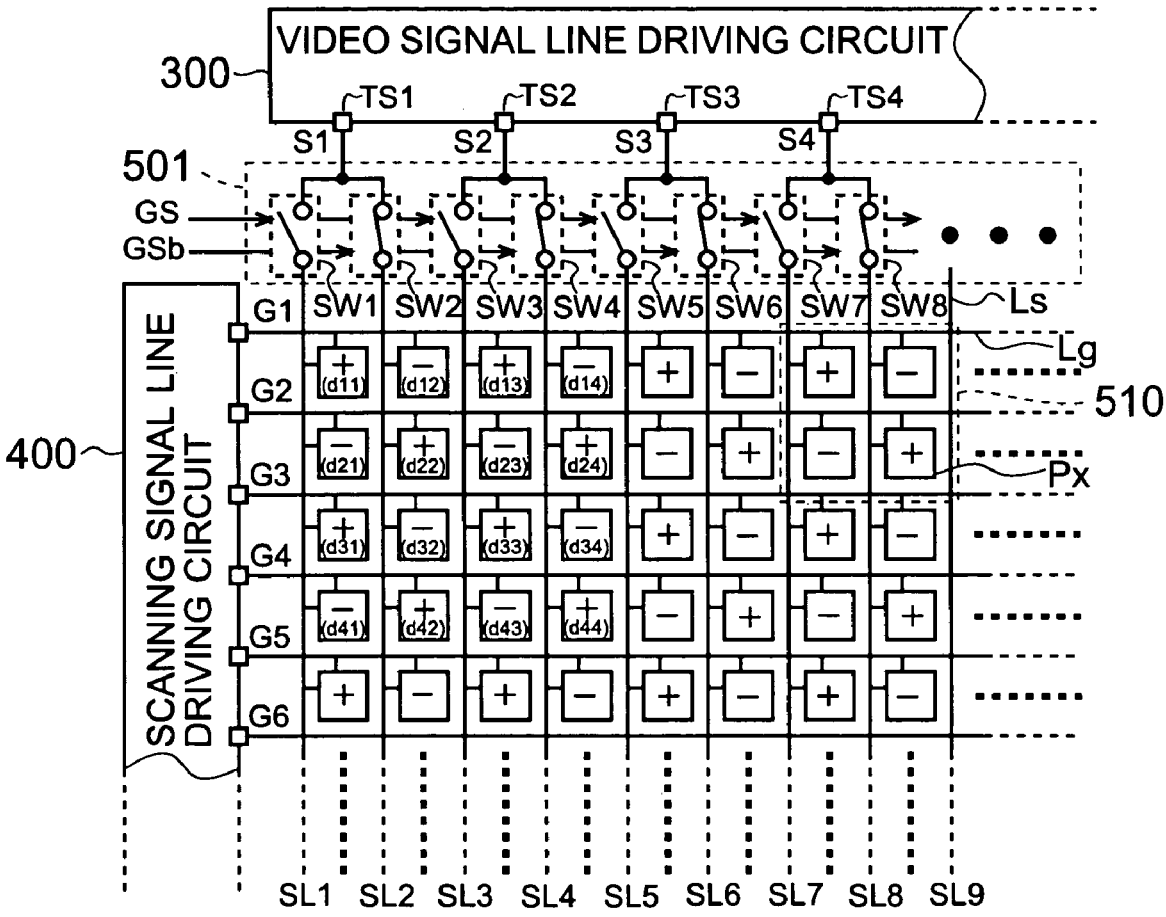
Fig. 3 PRIOR ART
FIG. 3 is a diagrammatic view showing the polarity pattern for the case that the true dot-inversion driving scheme is employed in a liquid crystal display device provided with a liquid crystal panel of the basic conventional configuration.

Referring to FIGS. 3 and 4A to 4F, the following is a description of a driving method for the case that a liquid crystal display device provided with a liquid crystal panel of the basic conventional configuration employs the dot-inversion driving scheme. In the following, in order to make a distinction to the "two-line dot-inversion driving scheme" explained below, in which the polarity is inverted in pairs of two scanning signal lines, the dot-inversion driving scheme in which the polarity is inverted at each single scanning signal line, as shown in FIG. 3, is referred to as "true dot-inversion driving scheme" or "one-line dot-inversion driving scheme."

FIG. 3 (corresponds to FIG. 2A) is a diagram showing the polarity pattern for the case that the true dot-inversion driving scheme is employed in a liquid crystal display device provided with a liquid crystal panel of the basic conventional configuration. As noted above, the "+" and "−" signs marking the pixel formation portions Px indicate the voltage polarity, and the references given in parentheses below the "+" and "−" signs indicate the pixel value to be written into the thus denoted pixel formation portion Px. (More specifically, the pixel value to be written into the pixel formation portion of the i-th row and the j-th column in the pixel matrix is denoted as "dij.") This method for expressing the polarity pattern in the liquid crystal panel and the pixel values to be written is also the same for the other drawings discussed below.

Figures 4A, 4B, 4C, 4D, 4E, 4F:
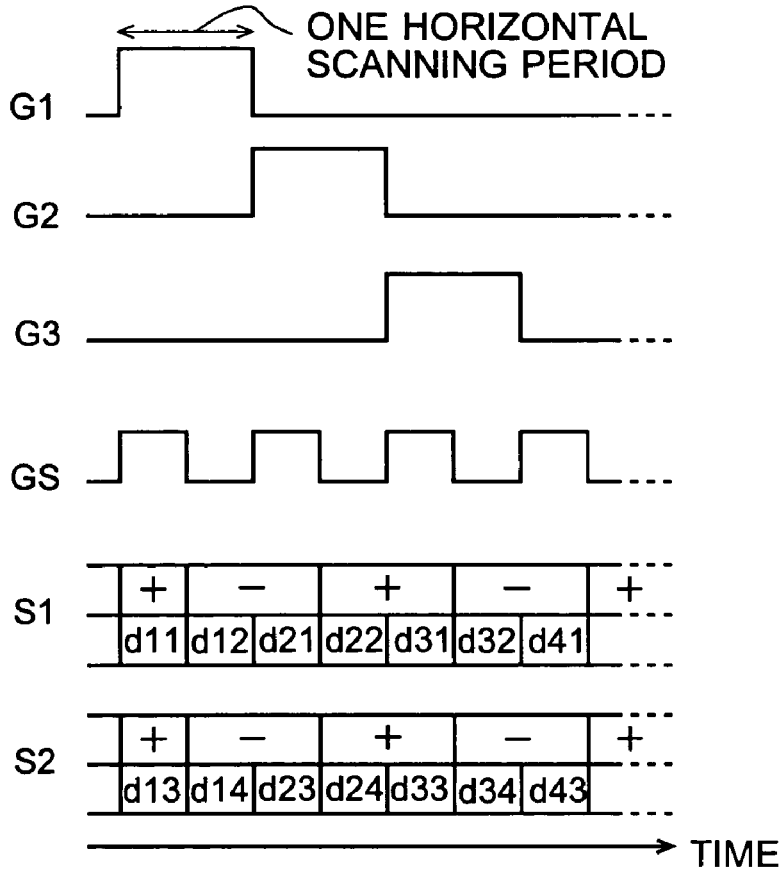
Fig. 4A PRIOR ART
Fig. 4B PRIOR ART
Fig. 4C PRIOR ART
Fig. 4D PRIOR ART
Fig. 4E PRIOR ART
Fig. 4F PRIOR ART
FIGS. 4A to 4F are timing charts illustrating a driving method for the case that the true dot-inversion driving scheme is employed in the liquid crystal display device provided with the liquid crystal panel of the basic conventional configuration.

FIGS. 4A to 4F are timing charts illustrating a driving method for the case that the true dot-inversion driving scheme is employed in the liquid crystal display device provided with the liquid crystal panel of the basic conventional configuration. As shown in FIGS. 4A to 4C, scanning signals G1, G2, G3, . . . that are successively at H level for one horizontal scanning period (one scanning line selection period) are respectively applied to the scanning signal lines Lg of the liquid crystal panel. With these scanning signals G1, G2, G3, . . . , each scanning signal line Lg takes on a selected (active) state when H level is applied thereto, and the TFTs 10 of the pixel formation portions Px connected to the selected scanning signal line Lg are turned on. Conversely, each scanning signal line Lg takes on an unselected (inactive) state when L level is applied thereto, and the TFTs 10 of the pixel formation portions Px connected to the unselected scanning signal line Lg are turned off.

As shown in FIG. 4D, the switching control signal GS is at H level in the first half and at L level in the second half of the horizontal scanning period (the period during which one of the scanning signals Gk (k=1, 2, 3, . . . is at H level). Here, the analog switches $SW_{2j-1}$ of the connection switching circuit 501 that are connected to the odd-numbered video signal lines Ls are on when the switching control signal GS is at H level, and are off when the switching control signal GS is at L level. On the other hand, the analog switches $SW_{2j}$ of the connection switching circuit 501 that are connected to the even-numbered video signal lines Ls are off when the switching control signal GS is at H level (GSb is at L level), and are on when the switching control signal GS is at L level (GSb is at H level). Consequently, the output terminals $TS_j$ of the video signal line driving circuit 300 are connected to the odd-numbered (numbered 2j−1) video signal lines Ls during the first half of each horizontal scanning period, and are connected to the even-numbered (numbered 2j) video signal lines Ls during the second half of each horizontal scanning period Thus, the video signal $S_1$ to be outputted from the output terminal $TS_1$ of the video signal line driving circuit 300 will be a signal as shown in FIG. 4E, and the video signal $S_2$ to be outputted from the output terminal $TS_2$ of the video signal line driving circuit 300 will be a signal as shown in FIG. 4F. Here, the timing charts in FIGS. 4E and 4F are made of an upper and a lower band. The upper bands indicate the polarity of the voltage of the video signals $S_1$ and $S_2$, and the lower bands indicate the pixel values of the video signals $S_1$ and $S_2$. (This method for expressing the timing charts of the video signal lines is also the same for the other drawings discussed below.)

In order to output such video signals, the video signal line driving circuit 300, first, successively receives the pixel values to be written into those pixel formation portions Px of the odd-numbered pixel columns of the pixel matrix whose TFTs 10 are turned on by the scanning signal Gk (for example the pixel values d11, d13, d15, . . . when G1 is at H level) from the display control circuit 200, and in the first half of the k-th horizontal scanning period, video signals $S_j$ corresponding to these pixel values are outputted from the output terminals $TS_j$ (j=1, 2, 3, . . . ). Next, the pixel values to be written into those pixel formation portions Px of the even-numbered pixel columns of the pixel matrix whose TFTs 10 are turned on by the scanning signal Gk (for example the pixel values d12, d14, d16, . . . when G1 is at H level) are successively inputted from the display control circuit 200, and in the second half of the k-th horizontal scanning period, video signals $S_j$ corresponding to these pixel values are outputted from the output terminals $TS_j$. Then, the video signal line driving circuit 300 repeatedly performs the above-described output (k=1, 2, 3, . . . ) so that the polarity of the video signals $S_1$, $S_2$, $S_3$, . . . corresponds to true dot-inversion driving with a polarity pattern as shown in FIG. 3. When the liquid crystal display device is driven in this manner, the voltage polarity of the video signals $S_1$, $S_2$, $S_3$, . . . for writing pixel values corresponding to true dot-inversion driving via the video signal lines Ls into the pixel formation portions Px is switched substantially once every horizontal scanning period, as can be seen in FIGS. 4E and 4F.

Figure 5:
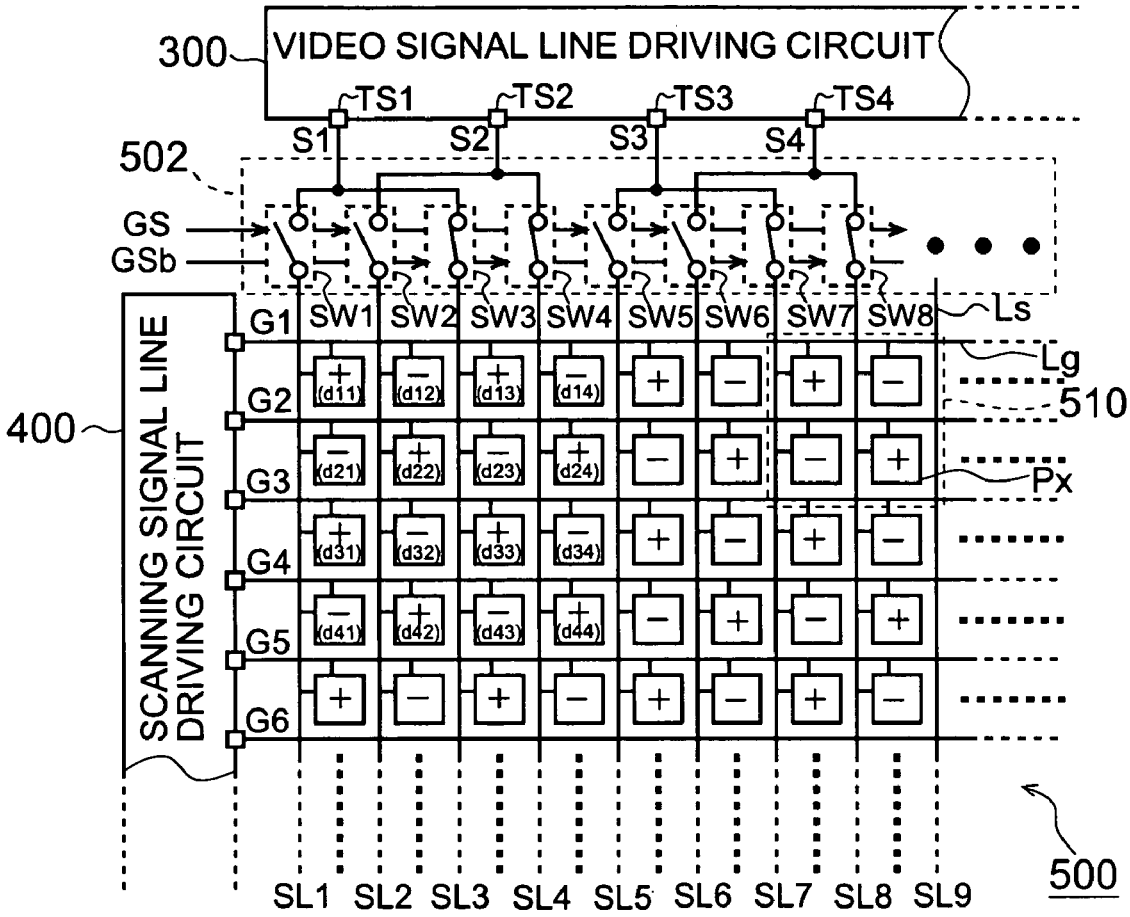
FIG. 5 is a diagrammatic view of the configuration of a liquid crystal panel in a liquid crystal display device according to this embodiment and the polarity pattern for the case that the true dot-inversion driving scheme is employed.

1.4 Liquid Crystal Panel According to Embodiment of the Invention and Method for Driving the Same 1.4.1 Configuration of Liquid Crystal Panel FIG. 5 is a diagrammatic view of the configuration of a liquid crystal panel 500 according to the present embodiment and the polarity pattern for the case that the true dot-inversion driving scheme is employed. Except for the configuration of the connection switching circuit, the configuration of this liquid crystal panel 500 is the same as in the basic conventional configuration, so that identical or corresponding portions are marked by the same reference numerals and a further detailed description thereof is omitted.

As in the basic conventional configuration shown in FIGS. 2A and 3, the connection switching circuit 502 of this liquid crystal panel 500 comprises analog switches $SW_1$, $SW_2$, $SW_3$, . . . corresponding to the video signal lines Ls on the liquid crystal panel 500, and one end of these analog switches $SW_i$ (i=1, 2, 3, . . . ) is connected to the corresponding video signal line Ls. The analog switches $SW_i$ are grouped into a plurality (namely, ½ the number of video signal lines Ls) of analog switch groups, by combining two analog switches to one analog switch group. However in this embodiment, as shown in FIG. 5, of analog switches in the connection switching circuit 502, two analog switches $SW_i$ and $SW_{i+2}$ (i=1, 2, 5, 6) that are spaced apart by one analog switch are grouped together to form one group. With regard to this, the present embodiment is different from the basic conventional configuration. In the present embodiment, the other ends of the two analog switches $SW_i$ and $SW_{i+2}$ belonging to the same group are connected to each other and are connected to one output terminal $TS_j$ of the video signal line driving circuit 300.

Thus, the video signal lines Ls of the liquid crystal panel 500 are grouped into a plurality of video signal line groups with two video signal lines spaced apart by one video signal line and forming one group, and each group of video signal lines (i.e. the two video signal lines Ls constituting each video signal line group) are connected via the two analog switches forming one group to one output terminal $TS_j$ of the video signal line driving circuit 300. This means that the output terminals $TS_j$ (j=1, 2, 3, . . . ) of the video signal line driving circuit 300 are in one-to-one correspondence to the video signal line groups, and each output terminal $TS_j$ is connected via the two analog switches SW forming one group to one video signal line group (two video signal lines Ls spaced apart by one video signal line Ls and forming one group).

Also in the present embodiment, the two analog switches $SW_i$ and $SW_{i+2}$ forming one group are configured so as to be reciprocally on and off in response to the switching control signal GS (and its logically inverted signal GSb). Consequently, the two analog switches $SW_i$ and $SW_{i+2}$ forming one group constitute a selector switch, and connect each output terminal $TS_j$ of the video signal line driving circuit 300 by time division to the two video signal lines of the corresponding video signal line group.

1.4.2 Driving Method for True Dot Inversion Driving

Next, a driving method for the case that the true dot-inversion driving scheme is employed in a liquid crystal display device according to the present embodiment provided with the above-described liquid crystal panel 500 is described with reference to FIGS. 5 and 6.

FIGS. 6A to 6F are timing charts illustrating a driving method for the case that the true dot-inversion driving scheme is employed in a liquid crystal display device provided with a liquid crystal panel 500 of the above-described configuration shown in FIG. 5. As shown in FIGS. 6A to 6D, the scanning signals Gk (k=1, 2, 3, . . . ) and the switching control signal GS are the same as in the case of the basic conventional configuration (FIGS. 4A to 4D), and thus the on/off operation of the TFTs 10 of the pixel formation portions Px due to the scanning signals Gk is also the same as in the case of the basic conventional configuration.

Moreover, the two analog switches $SW_i$ and $SW_{i+2}$ constituting each group are reciprocally turned on and off in response to the switching control signal GS (and its logically inverted signal GSb). In the connection switching circuit 502, of the analog switches $SW_i$ and $SW_{i+2}$, the leading analog switch $SW_i$ (i.e. the one with the smaller subscript) is referred to as the "A switch" and the trailing analog switch $SW_{i+2}$ (i.e. the one with the larger subscript) is referred to as the "B switch." In the first half of the horizontal scanning period, the A switches (in the configuration shown in FIG. 5 those are the analog switches $SW_1$, $SW_2$, $SW_5$ and $SW_6$) are on, and the B switches (the analog switches $SW_3$, $SW_4$, $SW_7$ and $SW_8$) are off, whereas in the second half of the horizontal scanning period, the A switches are off and the B switches are on. Consequently, in the first half of the horizontal scanning period, each output terminal $TS_j$ (j=1, 2, 3, . . . ) of the video signal line driving circuit 300 is connected to the video signal lines Ls connected to the A switch of the video signal line group corresponding to that output terminal $TS_j$, and in the second half of the horizontal scanning period, each output terminal $TS_j$ is connected to the video signal line Ls connected to the B switch of the video signal line group corresponding to that output terminal $TS_j$.

For example, the output terminals $TS_1$ and $TS_2$ are respectively connected to the first and second video signal lines Ls in the first half of the horizontal scanning period, and as a result, the video signals $S_1$ and $S_2$ outputted from the video signal line driving circuit 300 respectively become the video signal SL1 of the first video signal line Ls and the video signal SL2 of the second video signal line Ls. On the other hand, the output terminals $TS_1$ and $TS_2$ are connected to the third and fourth video signal lines Ls in the second half of the horizontal scanning period, and as a result, the video signals $S_1$ and $S_2$ outputted from the video signal line driving circuit 300 respectively become the video signal SL3 of the third video signal line Ls and the video signal SL4 of the fourth video signal line Ls.

Thus, the video signal S1 to be outputted from the output terminal $TS_1$ of the video signal line driving circuit 300 is for example the signal shown in FIG. 6E, and the video signal S2 to be outputted from the output terminal $TS_2$ is for example the signal shown in FIG. 6F. In order to output these video signals, the video signal line driving circuit 300 successively receives from the display control circuit 200 the pixel values to be written into those pixel formation portions Px of the (4j−3)th and the (4j−2)th pixel columns in the pixel matrix whose TFTs 10 are turned on by the scanning signal Gk (for example, the pixel values d11, d12, d15, d16, . . . when G1 is at H level), and in the first half of the k-th horizontal scanning period, the video signals $S_j$ and $S_{j+1}$ corresponding to these pixel values are respectively outputted from the output terminals $TS_j$ and $TS_{j+1}$ (j=1, 3, 5, . . . ). Then, the video signal line driving circuit 300 successively receives from the display control circuit 200 the pixel values to be written into those pixel formation portions Px of the (4j−1)th and the 4j-th pixel columns in the pixel matrix whose TFTs 10 are turned on by the scanning signal Gk (for example, the pixel values d13, d14, d17, d18, . . . when G1 is at H level), and in the second half of the k-th horizontal scanning period, the video signals $S_j$ and $S_{j+1}$ corresponding to these pixel values are respectively outputted from the output terminals $TS_j$ and $TS_{j+1}$ (j=1, 3, 5, . . . ). Then, the video signal line driving circuit 300 alternatingly repeats this output (k=1, 2, 3, . . . ), such that the voltage polarity of the video signals S1, S2, S3, . . . corresponds to true dot-inversion driving with the polarity pattern as shown in FIG. 5. When the liquid crystal display device is driven in this manner, the voltage polarity of the video signals $S_1$, $S_2$, $S_3$, . . . for writing the pixel values corresponding to true dot-inversion driving via the video signal lines Ls into the pixel formation portions Px is switched every horizontal scanning period, as can be seen in FIGS. 6E and 6F.

Consequently, in this embodiment, the switching period of the voltage polarity of the video signal $S_j$ outputted from the video signal line driving circuit 300 is the same as in the basic conventional configuration. Therefore, if the true dot-inversion driving scheme is employed in this embodiment, this embodiment is not particularly advantageous with regard to lowering the power consumption in comparison to the basic conventional configuration, according to Equation (1).

However, as explained in the first modification example described below, different to the basic conventional configuration, with the configuration of the liquid crystal panel 500 of this embodiment, the switching period of the voltage polarity of the video signal $S_j$ does not change even when the order of the connection switching of the video signal lines belonging to the same group is changed. Thus, by changing for example every each horizontal scanning period the order of the connection switching of the video signal lines of the same group, it becomes possible to suppress brightness irregularities in the displayed image without increasing the power consumption.

Figure 7A:
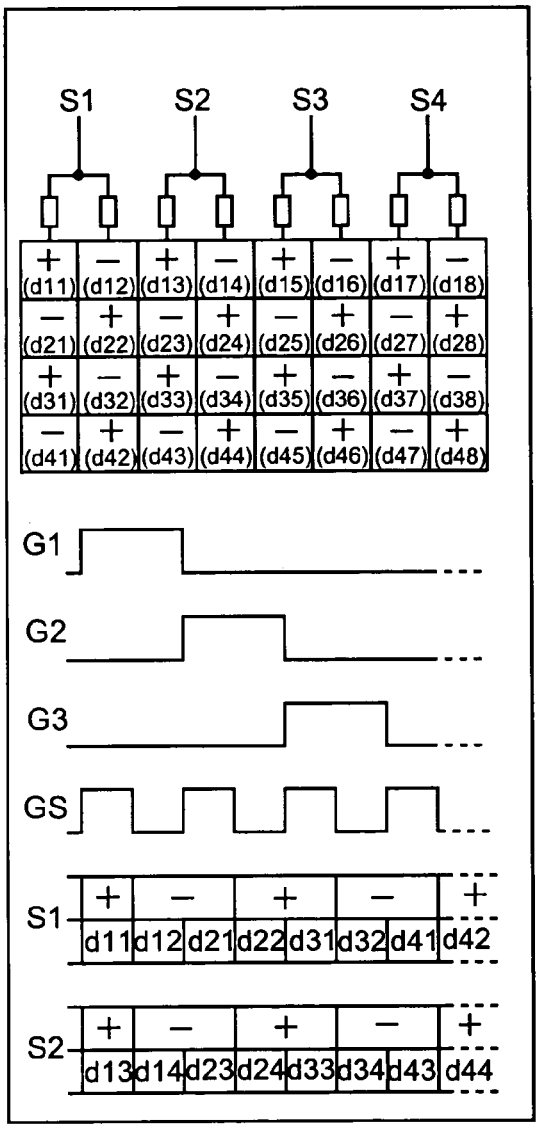
Fig. 7A PRIOR ART
FIG. 7A shows a diagram illustrating the configuration of the connection switching circuit and the polarity pattern for the case that the one-line dot-inversion driving scheme is employed in the basic conventional configuration, as well as the timing charts corresponding to this diagram.
Figure 7B:
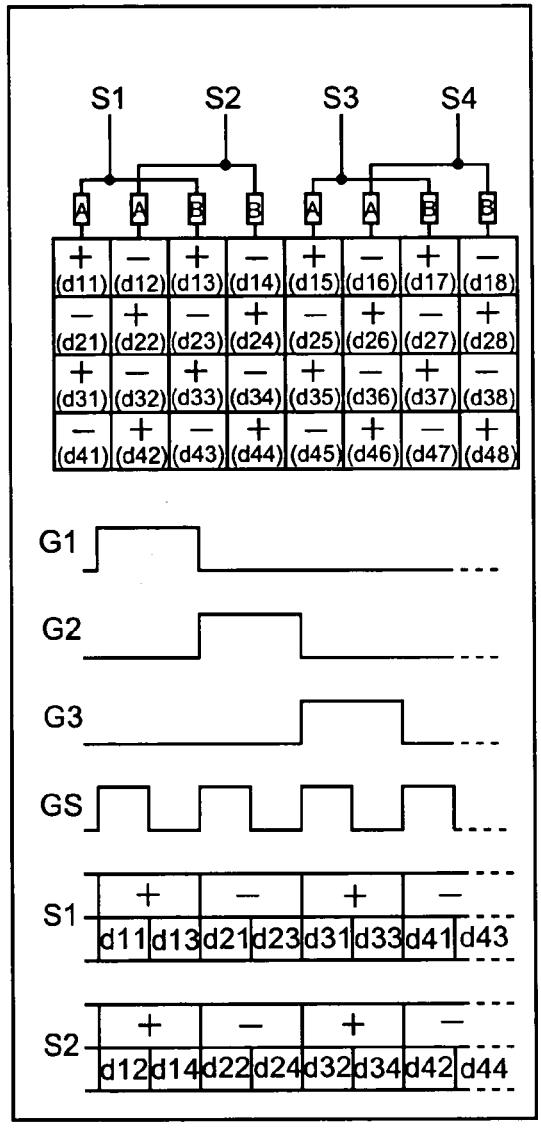
FIG. 7B shows a diagram illustrating the configuration of the connection switching circuit and the polarity pattern for the case that the one-line dot-inversion driving scheme is employed in this embodiment, as well as the timing charts corresponding to this diagram.

In the following, in order to discuss the power consumption for the case that another scheme is employed as the AC driving scheme in the present embodiment, diagrams illustrating the connection switching circuit and the polarity pattern in a simplified manner are introduced, and these diagrams and timing charts are shown in comparison to the basic conventional configuration. That is to say, when discussing the power consumption in the present embodiment for the case that the true dot-inversion driving scheme is employed, the diagram and timing charts are compared to the basic conventional configuration, as shown in FIGS. 7A and 7B. FIG. 7A shows a diagram illustrating the configuration and the polarity pattern of FIG. 3 as well as the timing charts corresponding to this diagram, and FIG. 7B shows a diagram illustrating the configuration and the polarity pattern of FIG. 5 as well as the timing charts corresponding to this diagram. In these diagrams, to keep the illustration simple, the pixel matrix is shown as a configuration of 4 rows and 8 columns (the same is true in the following unless indicated otherwise).

1.4.3 Driving Method for Two-Line Dot Inversion Driving

Figure 8A:
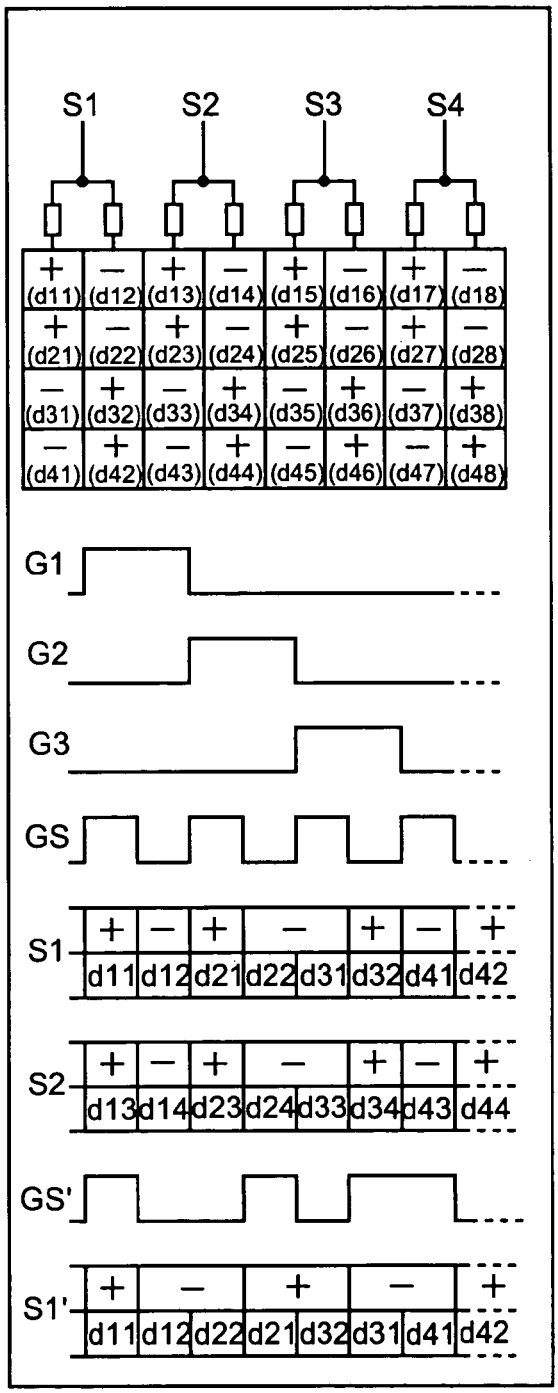
Fig. 8A PRIOR ART
FIG. 8A shows a diagram illustrating the configuration of the connection switching circuit and the polarity pattern for the case that the two-line dot-inversion driving scheme is employed in the basic conventional configuration, as well as the timing charts corresponding to this diagram.
Figure 8B:
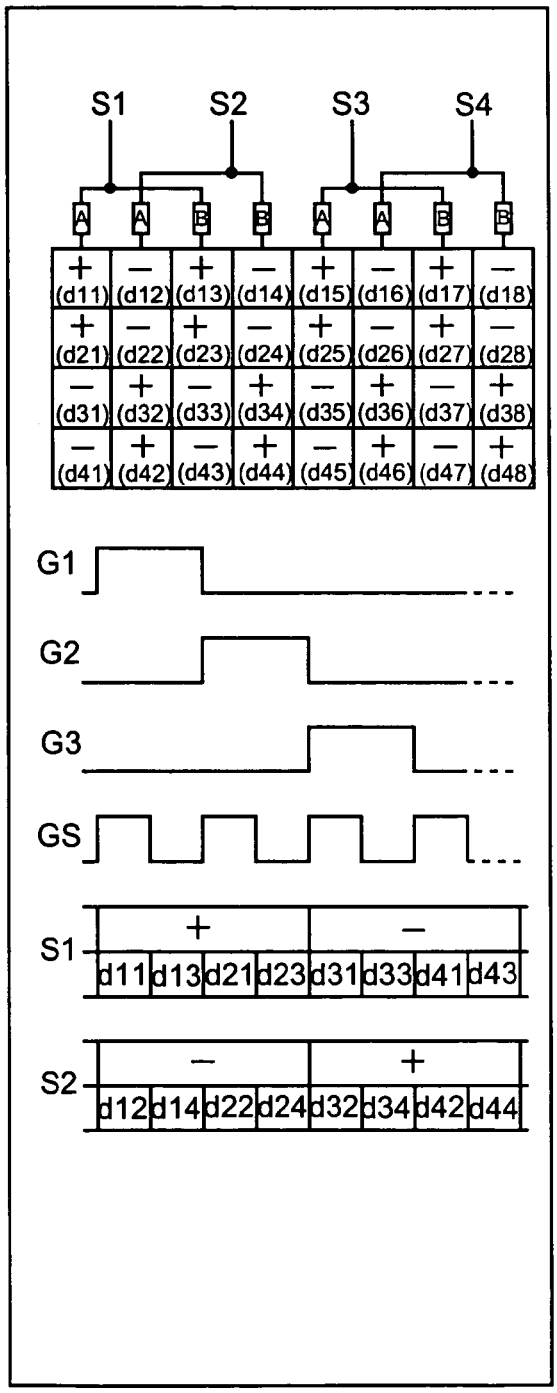
FIG. 8B shows a diagram illustrating the configuration of the connection switching circuit and the polarity pattern for the case that the two-line dot-inversion driving scheme is employed in this embodiment, as well as the timing charts corresponding to this diagram.

Referring to FIGS. 8A and 8B, the following is a description of a driving method for the case that a two-line dot-inversion driving scheme is employed in the liquid crystal display device provided with the above-described liquid crystal panel 500, in comparison with the driving method of the basic conventional configuration. Here, "two-line dot-inversion driving scheme" means an AC driving scheme in which the polarity of the voltage applied to the liquid crystal layer forming the pixels is inverted at each two scanning signal lines and at each video signal line (and also inverted at each frame), as shown in the diagrams of FIGS. 8A and 8B.

FIG. 8A shows a diagram illustrating the basic conventional configuration and the polarity pattern of the two-line dot-inversion driving scheme, as well as timing charts of the scanning signals G1 to G3, the switching control signal GS and the video signals $S_1$ and $S_2$ corresponding to this diagram, and the switching control signal GS' and video signal S1' according to another example. As shown in the timing charts of FIG. 8A, the scanning signals Gk (k=1, 2, 3, . . . ) and the switching control signal GS are the same as when the true dot-inversion driving scheme is employed (see FIGS. 4A to 4D and FIG. 7A). Consequently, in the first half of the horizontal scanning period, the video signals $S_1$ and $S_2$ outputted from the video signal line driving circuit 300 are respectively applied to the first video signal line and the third video signal line, and thus, the pixel values are written into the pixel formation portions of the first column and the third column of the pixel matrix. On the other hand, in the second half of the horizontal scanning period, the video signals $S_1$ and $S_2$ outputted from the video signal line driving circuit 300 are respectively applied to the second video signal line and the fourth video signal line, and thus, the pixel values are written into the pixel formation portions of the second column and the fourth column of the pixel matrix. However, since the two-line dot-inversion driving scheme is employed, the switching period of the voltage polarity of the video signals S1 and S2 is different to the case of the true dot-inversion driving scheme, and is about ½ the horizontal scanning period. Therefore, according to Equation (1), it is disadvantageous compared to the true dot-inversion driving scheme with regard to power consumption.

However, if GS' of FIG. 8A is used instead of GS as the switching control signal, and the order in which the two video signal lines of the same group are connected to one of the output terminals $TS_j$ of the video signal line driving circuit 300 is changed, then the switching period of the polarity of the video signals outputted from the video signal line driving circuit 300 can be set to substantially one horizontal scanning period. That is to say, in this case, the video signal from the output terminal $TS_1$ of the video signal line driving circuit 300 becomes the signal shown as $S_1$' in FIG. 8A. However, if the two-line dot-inversion driving scheme is employed in the basic conventional configuration, the switching period of the voltage polarity of the video signals outputted from the video signal line driving circuit 300 cannot be made longer than one horizontal scanning period.

FIG. 8B shows a diagram illustrating the liquid crystal panel configuration according to the present embodiment and the polarity pattern of the two-line dot-inversion driving scheme, as well as timing charts of the scanning signals G1 to G3, the switching control signal GS and the video signals $S_1$ and $S_2$ corresponding to this diagram. As shown in the timing charts of FIG. 8B, the scanning signals Gk (k=1, 2, 3, . . . ) and the switching control signal GS are the same as when the true dot-inversion driving scheme is employed (see FIGS. 6A to 6D and FIG. 7B). Consequently, in the first half of the horizontal scanning period, the video signals outputted from the video signal line driving circuit 300 are applied to the video signal lines connected to the A switches (the leading ones of the two analog switches of the same group). For example, the video signals $S_1$ and $S_2$ outputted from the video signal line driving circuit 300 are respectively applied to the first video signal line and the second video signal line, and thus the pixel values are written into the pixel formation portions of the first column and the second column of the pixel matrix. On the other hand, in the second half of the horizontal scanning period, the video signals $S_1$ and $S_2$ outputted from the video signal line driving circuit 300 are applied to the video signal lines connected to the B switches (the trailing ones of the two analog switches of the same group). For example, the video signals $S_1$ and $S_2$ outputted from the video signal line driving circuit 300 are respectively applied to the third video signal line and the fourth video signal line, and thus, the pixel values are written into the pixel formation portions of the third column and the fourth column of the pixel matrix.

Here, the analog switches $SW_1$, $SW_2$, $SW_3$, . . . are grouped into groups of analog switches connected to two video signal lines Ls with one analog switch placed in between, so that in the case of the two-line dot-inversion driving scheme, the polarities of the voltages to be applied to the two video signal lines within the same group are the same and do not change for two horizontal scanning periods. Therefore, as shown in the timing chart of FIG. 8B, the switching period of the voltage polarity of the video signals $S_1$ and $S_2$ becomes two horizontal scanning periods. As a result, according to Equation (1), the power consumption for driving the video signal lines is reduced greatly (to ½ or even less according to a simple calculation), compared to the prior art.

1.4.4 Driving Method for Source Inversion Driving

Figure 9A:
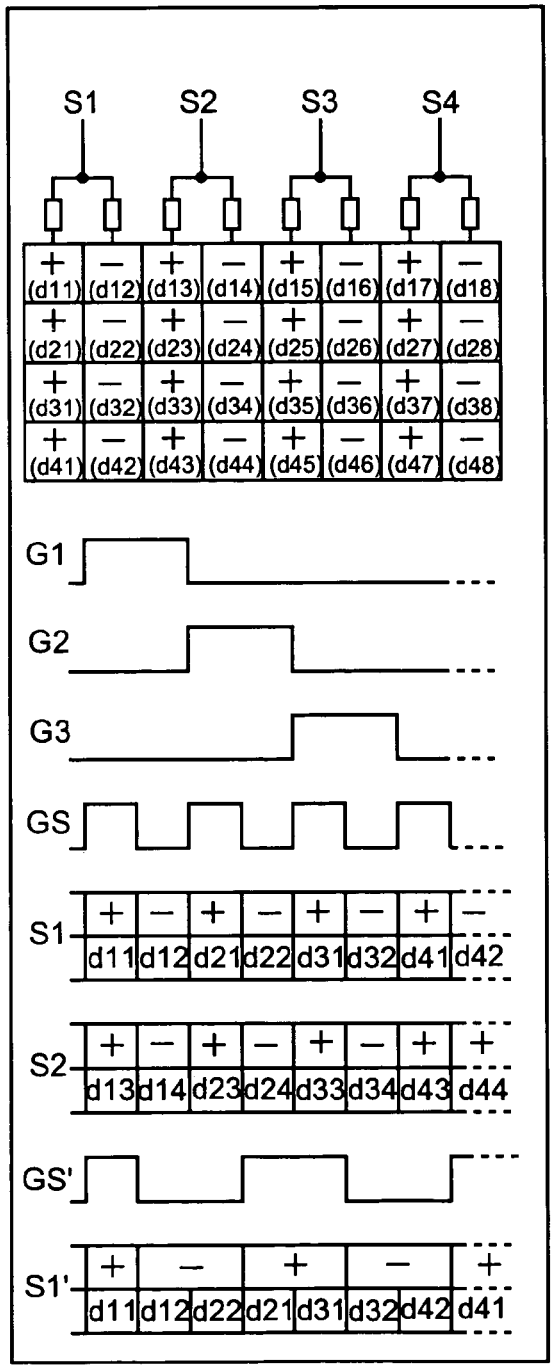
Fig. 9A PRIOR ART
FIG. 9A shows a diagram illustrating the configuration of the connection switching circuit and the polarity pattern for the case that the source-inversion driving scheme is employed in the basic conventional configuration, as well as the timing charts corresponding to this diagram.
Figure 9B:
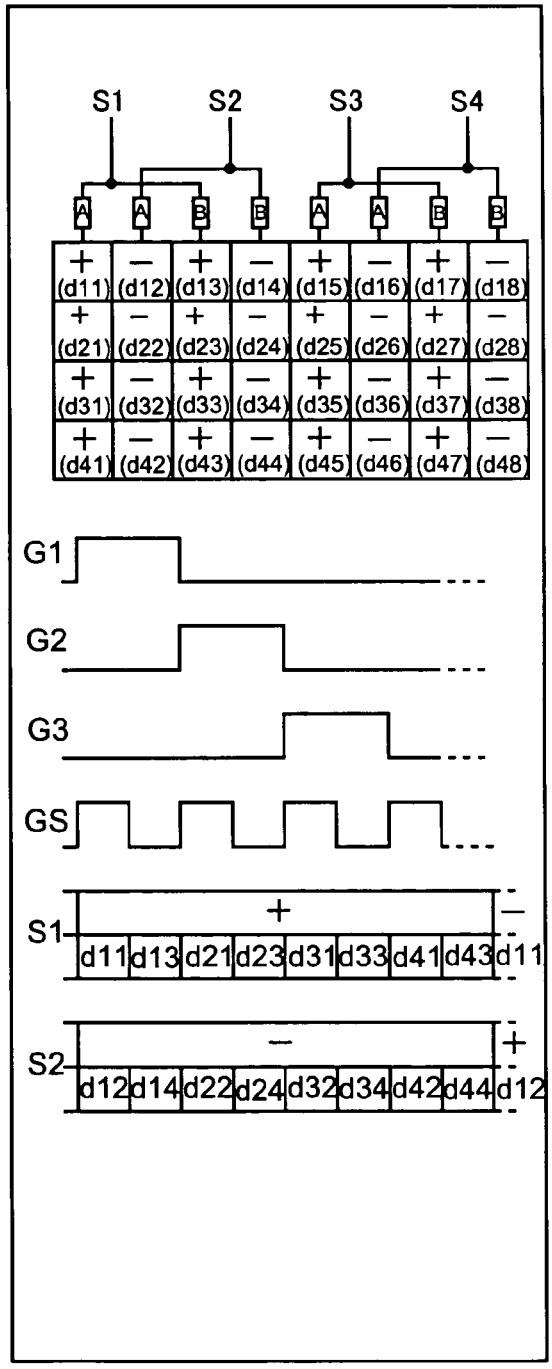
FIG. 9B shows a diagram illustrating the configuration of the connection switching circuit and the polarity pattern for the case that the source-inversion driving scheme is employed in this embodiment, as well as the timing charts corresponding to this diagram.

Referring to FIGS. 9A and 9B, the following is a description of a driving method for the case that a source-inversion driving scheme is employed in the liquid crystal display device provided with the above-described liquid crystal panel 500, in comparison with the driving method of the basic conventional configuration. Here, "source-inversion driving scheme" means an AC driving scheme in which the polarity of the voltage applied to the liquid crystal layer forming the pixels is inverted at each video signal line but without change in the scanning signal lines (and also inverted at each frame), as shown in the diagrams of FIGS. 9A and 9B.

FIG. 9A shows a diagram illustrating the basic conventional configuration and the polarity pattern of the source-inversion driving scheme, as well as timing charts of the scanning signals G1 to G3, the switching control signal GS and the video signals $S_1$ and $S_2$ corresponding to this diagram, and the switching control signal GS' and video signal S1' according to another example. As shown in the timing charts of FIG. 9A, the scanning signals Gk (k=1, 2, 3, . . . ) and the switching control signal GS are the same as when the true dot-inversion driving scheme is employed (see FIGS. 4A to 4D and FIG. 7A), but since the source-inversion driving scheme is employed, the switching period of the voltage polarity of the video signals $S_1$ and $S_2$ is different from the case of the true dot-inversion driving scheme, namely ½ horizontal scanning period. However, also in this case, if GS' of FIG. 9A is used instead of GS as the switching control signal, and the order in which the two video signal lines of the same group are connected to one of the output terminals $TS_j$ of the video signal line driving circuit 300 is changed, then the video signal from the output terminal $TS_1$ of the video signal line driving circuit 300 becomes the signal shown as $S_1$' in FIG. 9A. Thus, the switching period of the voltage polarity of the video signal outputted from the video signal line driving circuit 300 can be set to substantially one horizontal scanning period. However, if the source-inversion driving scheme is employed in the basic conventional configuration, the switching period of the voltage polarity of the video signals outputted from the video signal line driving circuit 300 cannot be made longer than one horizontal scanning period.

FIG. 9B shows a diagram illustrating the liquid crystal panel configuration according to the present embodiment and the polarity pattern of the source-inversion driving scheme, as well as timing charts of the scanning signals G1 to G3, the switching control signal GS and the video signal $S_1$ and $S_2$ corresponding to this diagram. As shown in the timing charts of FIG. 9B, the scanning signals Gk (k=1, 2, 3, . . . ) and the switching control signal GS are the same as when the true dot-inversion driving scheme is employed (see FIGS. 6A to 6D and FIG. 7B). Consequently, in the first half of the horizontal scanning period, the video signals outputted from the video signal line driving circuit 300 are applied to the video signal lines connected to the A switches, which are the leading ones of the two analog switches of the same group, and in the second half of the horizontal scanning period, they are applied to the video signal lines connected to the B switches, which are the trailing ones of the two analog switches of the same group.

Here, the analog switches $SW_1$, $SW_2$, $SW_3$, . . . are grouped into groups of analog switches connected to two video signal lines Ls with one video signal line placed in between, so that in the case of the source-inversion driving scheme, the polarities of the voltages to be applied to the two video signal lines within the same group are the same and do not change for one frame period (one vertical scanning period). For example, the video signals $S_1$ and $S_2$ outputted from the video signal line driving circuit 300 become as shown in the timing chart of 9B. Thus, if the source-inversion driving scheme is employed in the present embodiment, the switching period of the video signals $S_j$ outputted from the video signal line driving circuit 300 becomes one frame period (one vertical scanning period), and compared to the prior art (FIG. 9A), the power consumption for driving the video signal lines is reduced greatly.

1.5 Advantageous Effect

As described above, according to the present embodiment, the video signal lines Ls of the liquid crystal panel 500 are grouped into groups of two video signal lines that are spaced apart by one video signal line (or more generally an odd number of video signal lines). Therefore, the voltage polarities of the video signal lines within the same group are the same, even when AC driving scheme in which, like the dot-inversion driving scheme or the source-inversion driving scheme, the polarity of the driving video signals is inverted at each video signal line. Thus, with the present embodiment, a reduction of the power consumption can be achieved while preserving the advantage of time-division driving of the video signal lines, in which the video signal lines Ls of the liquid crystal panel 500 are grouped into groups of two video signal lines and within each group the video signal line connected to one of the output terminals TSj of the video signal line driving circuit 300 is successively switched.

As can be seen from the above, moreover, according to the present embodiment, in the case of n-line dot-inversion driving scheme (n=1 or n>1) that is an AC driving scheme in which the polarity of the voltage applied to the liquid crystal layer forming the pixels is inverted at each n scanning signal lines and at each video signal line, the polarities of the voltages to be applied to the two video signal lines within the same group are the same and do not change for n horizontal scanning periods, and therefore the switching period of the polarity of the video signals becomes n horizontal scanning periods. More specifically, in this case, every time the scanning signal line selected by the scanning signal line driving circuit 400 is switched n times, the video signal line driving circuit inverts the polarity of the video signals Sj outputted from the output terminals TSj (the voltage polarity of the video signals taking the opposing electrode Ec as reference potential) (j=1, 2, 3, . . . ). Accordingly, the larger the value of n is, the less the power consumption will be. It should be noted that if n equals to the number of the scanning signal lines Lg, the n-line dot-inversion driving scheme means the source-inversion driving scheme.

2. First Modification Example

Figure 10A:
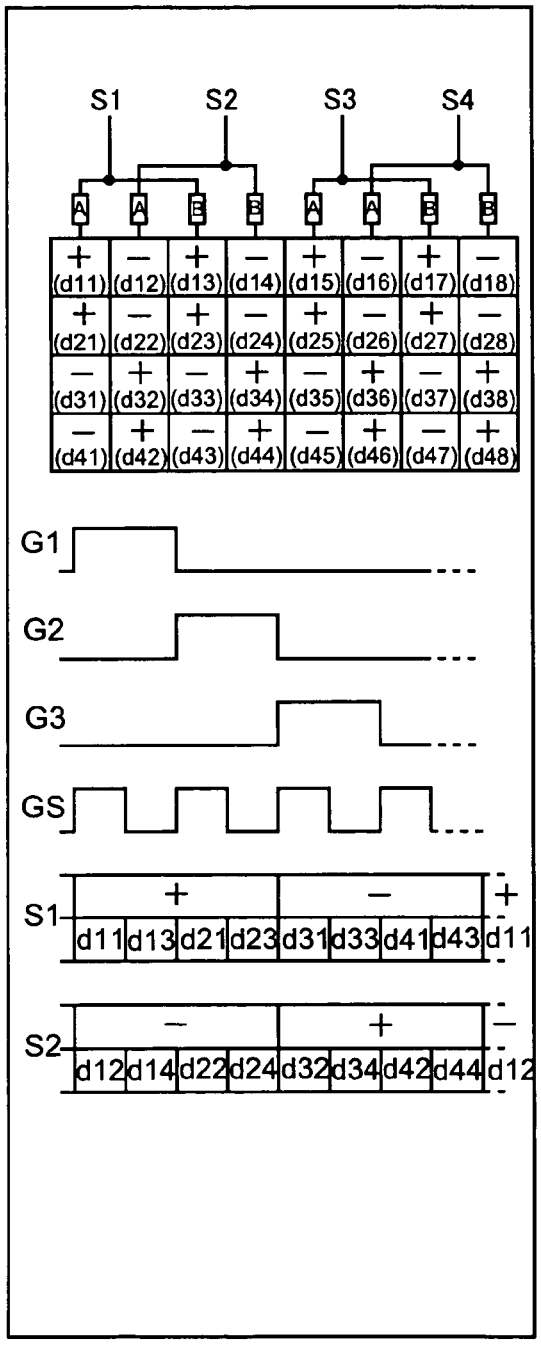
FIG. 10A shows a diagram illustrating the configuration of the connection switching circuit and the polarity pattern for the case that the two-line dot-inversion driving scheme is employed in this embodiment, as well as the timing charts corresponding to this diagram.

In the above-described embodiment, the switching control signal GS as shown in the timing chart of FIG. 10A is at H level in the first half and at L level in the second half of the horizontal scanning period. Therefore, the output terminals $TS_j$ of the video signal line driving circuit 300 are always connected to the video signal lines Ls connected to the A switches during the first half of the horizontal scanning period, and are always connected to the video signal lines Ls connected to the B switches during the second half of the horizontal scanning period. Consequently, in all horizontal scanning periods, the order in which the two video signal lines Ls belonging to the same group are connected to one of the output terminals of the video signal line driving circuit 300 corresponding to that group, that is, the order of the connection switching of the video signal lines Ls in the same group is fixed.

Figure 10B:
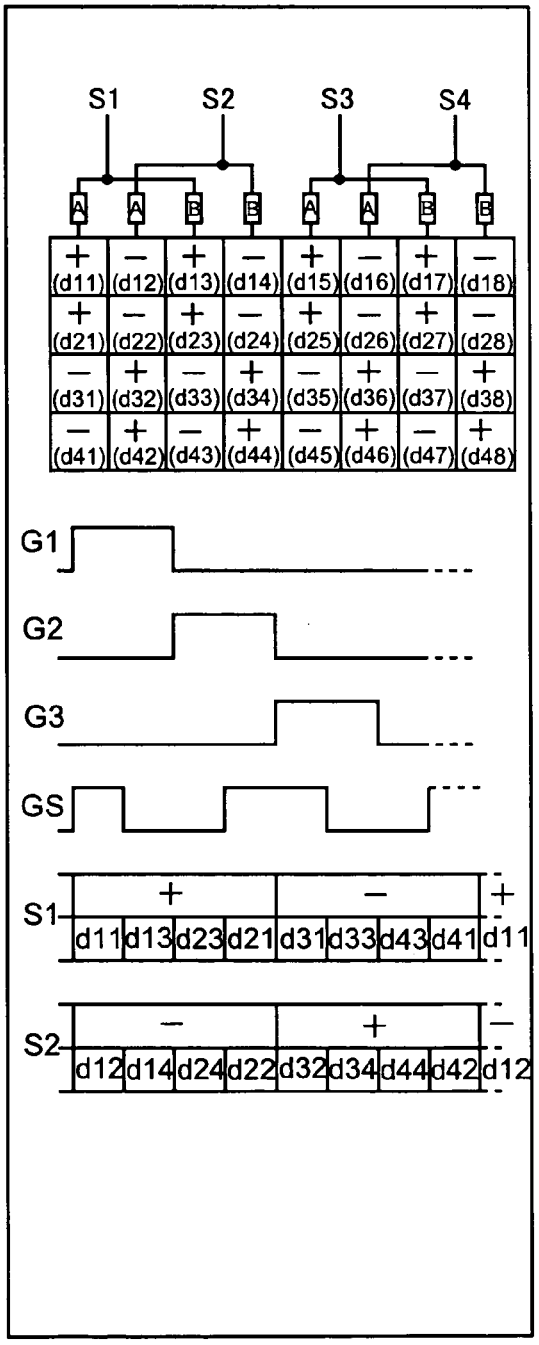
FIG. 10B shows a diagram illustrating the configuration of the connection switching circuit and the polarity pattern for the case that the two-line dot-inversion driving scheme is employed in a first modification example, as well as the timing charts corresponding to this diagram.

On the other hand, in this modification example, by using a switching control signal GS as shown in the timing chart of FIG. 10B, the order of the connection switching of the video signal lines Ls of the same group is changed at each horizontal scanning period. That is to say, in the first half of a given horizontal scanning period, the video signal lines Ls connected to the A switches are connected to the output terminals of the video signal line driving circuit 300, and in the second half, the video signal lines Ls connected to the B switches are connected to the output terminals of the video signal line driving circuit 300, but in the first half of the next horizontal scanning period, the video signal lines Ls connected to the B switches are connected to the output terminals of the video signal line driving circuit 300, and in the second half, the video signal lines Ls connected to the A switches are connected to the output terminals of the video signal line driving circuit 300. FIG. 10B shows a timing chart of the video signals $S_1$ and $S_2$ from the video signal line driving circuit 300 for the case that the order of the connection switching for the video signal lines Ls of the same group is changed every horizontal scanning period. As can be seen from this timing chart, also in this modification example, the switching period of the voltage polarity of the video signals $S_1$ and $S_2$ is two horizontal scanning periods, so that there is no particular disadvantage compared to the above-described embodiment with regard to power consumption.

However, if, as in the above-described embodiment, the order in which the video signal lines Ls of the same group are connected to one of the output terminals $TS_j$ of the video signal line driving circuit 300 (i.e. the order of the connection switching) is fixed, then brightness irregularities may occur in the displayed image and the image quality may deteriorate due to the influence of the parasitic capacitance between the pixel electrodes Ep of the pixel formation portions Px and the neighboring video signal line Ls. That is to say, even when the voltages of the video signals $S_j$ from the video signal line driving circuit 300 are the same, depending on whether the voltages are applied to the video signal lines Ls in the first half or in the second half of the horizontal scanning period, a discernible difference in display brightness may occur, and in this case, brightness irregularities in the displayed image may occur if the order of the connection switching is fixed. On the other hand, with this modification example, the order of the connection switching of the video signal lines Ls in the same group is changed every horizontal scanning period, so that the brightness irregularities in the displayed image due to the influence of parasitic capacitance or the like are dispersed, and the brightness irregularities can be made non-conspicuous.

3. Second Modification Example

Figure 11:
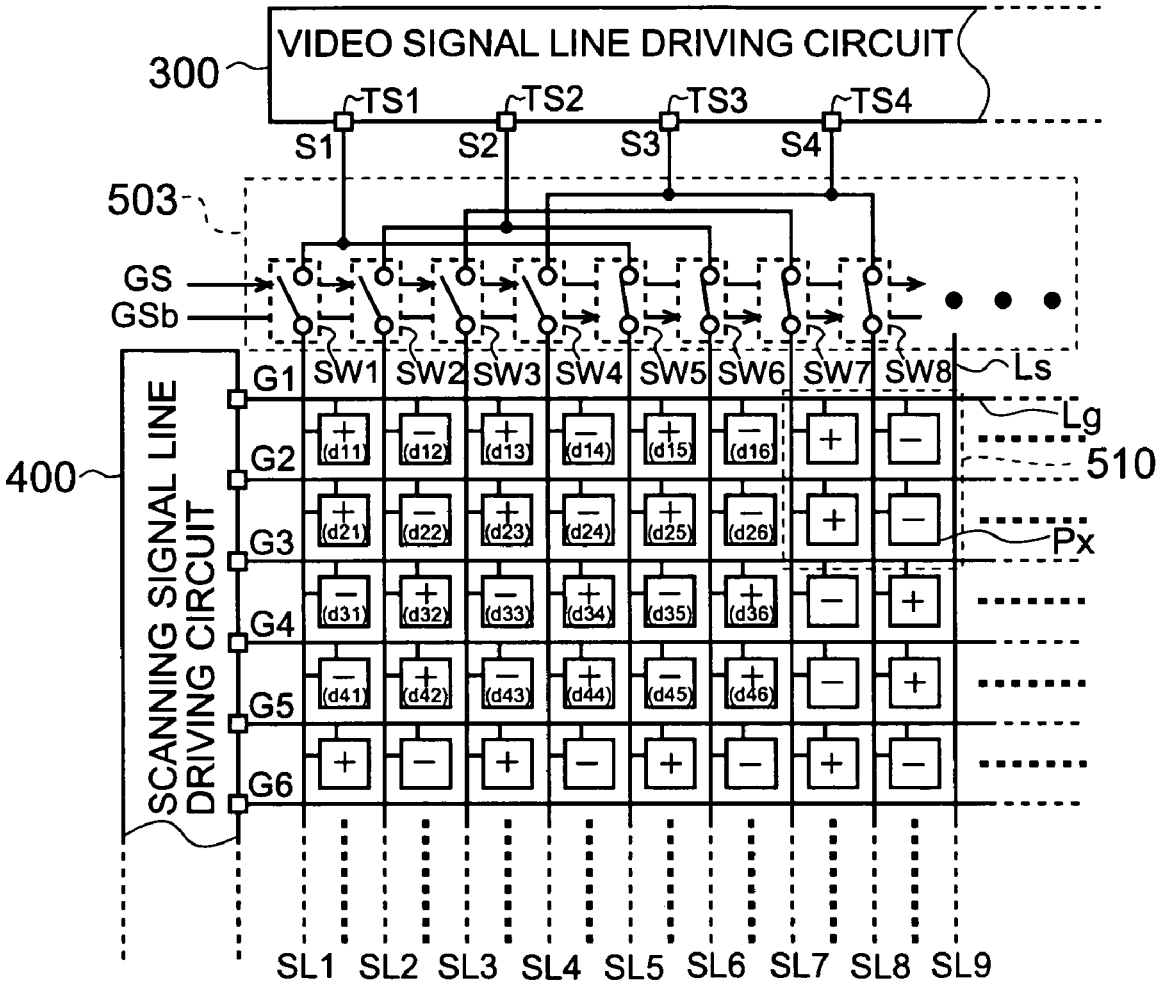
FIG. 11 is a diagrammatic view showing the configuration of a liquid crystal panel according to a second modification example.

In the above-described embodiment, two analog switches $SW_i$ and $SW_{i+2}$ (i=1, 2, 5, 6, . . . ), spaced apart on the connection switching circuit 502 by one analog switch, are grouped together to one group, but instead of spacing them apart by one analog switch, they may also be spaced apart by any odd number of analog switches. For example, as shown in FIG. 11, it is also possible to group together two analog switches $SW_i$ and $SW_{i+4}$ (i=1, 2, 3, 4, 9, 10, . . . ) that are spaced apart on a connection switching circuit 503 by three analog switches to one group. In this case, two video signal lines Ls of the liquid crystal panel that are spaced apart by three video signal lines are grouped together to one group, and two video signal lines Ls constituting a group are connected via analog switches by time division to one of the output terminals $TS_j$ of the video signal line driving circuit 300. Then, if AC driving is performed in which the polarity of the voltage applied to the liquid crystal layer forming the pixels is inverted at each video signal line, then the voltage polarities of the video signal lines Ls of the same group are the same and do not change for a least one horizontal scanning period, so that the same effect as in the above-described embodiment can be attained with regard to a reduction of power consumption.

Figures 12A, 12B, 12C, 12D, 12E, 12F:
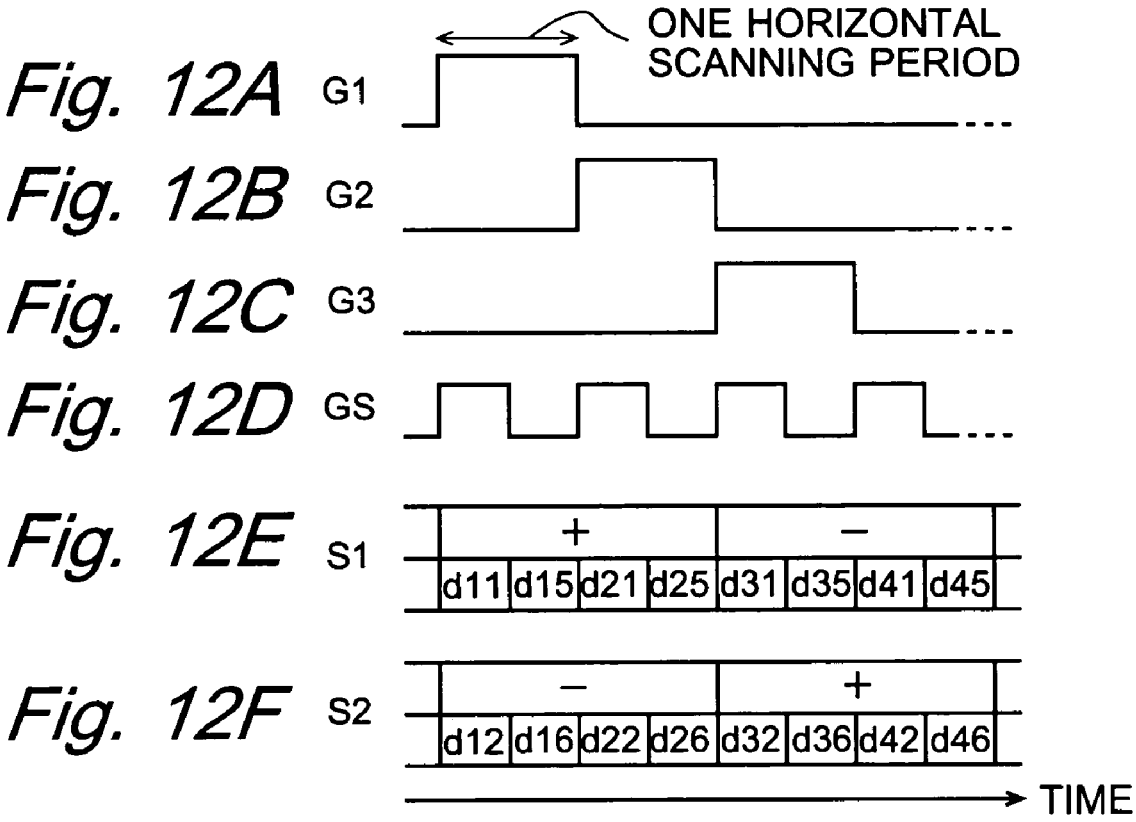
FIGS. 12A to 12F are timing charts illustrating a driving method for a liquid crystal display device according to the second modification example.

For example, if the two-line dot-inversion driving scheme as shown in FIG. 11 is employed, the voltage polarities of the video signal lines Ls of the same group are the same and do not change for two horizontal scanning periods. And by using a scanning signal Gk (k=1, 2, 3, . . . ) as shown in FIGS. 12A to 12C and a switching control signal GS as shown in FIG. 12D, the video signals $S_1$ and $S_2$ to be outputted from the video signal line driving circuit 300 will be the signals shown in FIGS. 12E and 12F, respectively. As can be seen from this timing chart, with this modification example, the switching period of the voltage polarity of the video signals $S_1$ and $S_2$ is two horizontal scanning periods, and the same effect can be attained as in the case of employing the two-line dot-inversion driving scheme in the above-described embodiment.

4. Third Modification Example

Figure 13:
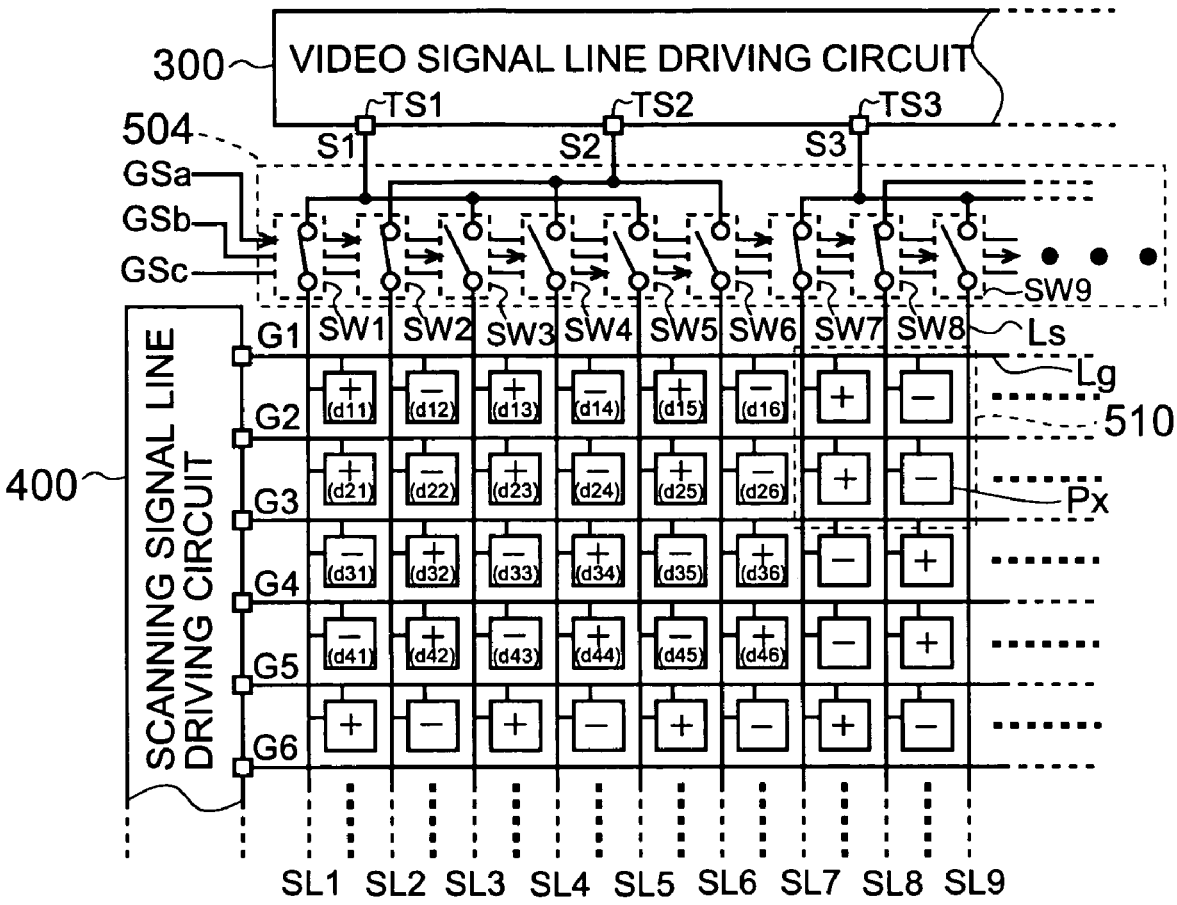
FIG. 13 is a diagrammatic view showing the configuration of a liquid crystal panel according to a third modification example.

In the above-described embodiment, two analog switches $SW_i$ and $SW_{i+2}$ (i=1, 2, 5, 6, . . . ), spaced apart on the connection switching circuit 502 by one analog switch, are grouped together to one group, but instead of grouping together two analog switches to one group, it is also possible to group together three or more analog switches to one group, respectively spaced apart by one analog switch (or more generally an odd number of analog switches). For example, as shown in FIG. 13, the three analog switches $SW_i$, $SW_{i+2}$ and $SW_{i+4}$ (i=1, 2, 7, 8, . . . ), which are respectively spaced apart by one analog switch on the connection switching circuit 504, may be grouped together to one group. In this case, three video signal lines Ls of the liquid crystal panel that are spaced apart by one video signal line are grouped together to one group, and the three video signal lines Ls constituting a group are connected via analog switches by time division to one of the output terminals $TS_j$ of the video signal line driving circuit 300. If AC driving is performed in which the polarity of the voltage applied to the liquid crystal layer forming the pixels is inverted at each video signal line, then the voltage polarities of the video signal lines Ls of the same group are the same and do not change for a least one horizontal scanning period, so that the same effect as in the above-described embodiment can be attained with regard to reduction of power consumption.

Figures 14A, 14B, 14C, 14D, 14E, 14F, 14G, 14H:
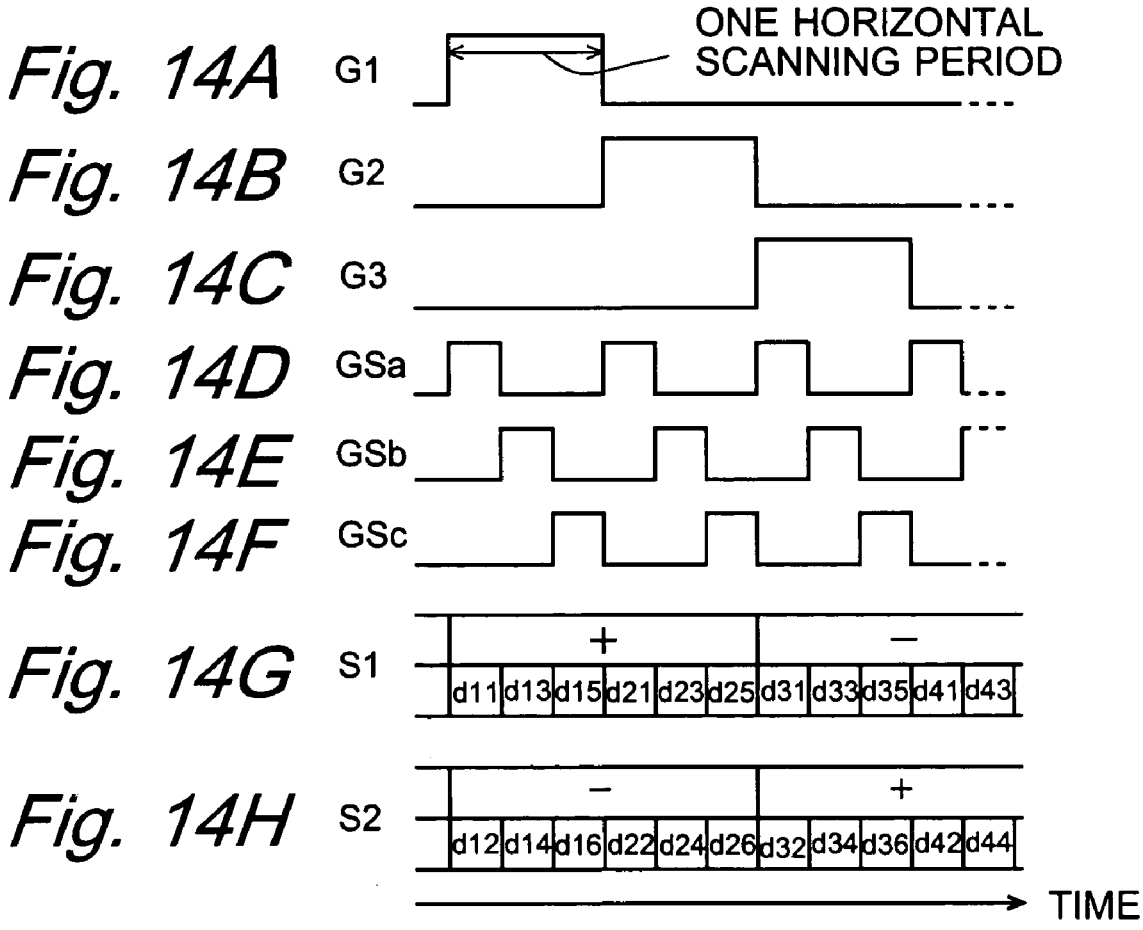
FIGS. 14A to 14H are timing charts illustrating a driving method for a liquid crystal display device according to the third modification example.

For example, if the two-line dot-inversion driving scheme as shown in FIG. 13 is employed, the voltage polarities of the video signal lines Ls of the same group are the same and do not change for two horizontal scanning periods. And by using a scanning signal Gk (k=1, 2, 3, . . . ) as shown in FIGS. 14A to 14C and switching control signals GSa, GSb, and GSc as shown in FIGS. 14D to 14F, the video signals $S_1$ and $S_2$ to be outputted from the video signal line driving circuit 300 will be signals as shown in FIGS. 14G and 14H, respectively. Here, when the three analog switches $SW_i$, $SW_{i+2}$ and $SW_{i+4}$ constituting one group are referred to as "A switch," "B switch" and "C switch," in order starting with the leading one (the one with the lowest subscript), then the A switch is turned on and off by the switching control signal GSa, the B switch is turned on and off by the switching control signal GSb, and the C switch is turned on and off by the switching control signal GSc. Each of these switches is turned on when the switching control signal is at H level and off when the switching control signal is at L level.

As can be seen from this timing charts in FIGS. 14G and 14H, with this modification example, the time division number is increased from 2 to 3, and the same effect with regard to reduction of power consumption can be attained as in the above-described embodiment. That is to say, with this modification example, if the two-line dot-inversion driving scheme is employed, the switching period of the voltage polarity of the video signals S1 and S2 is two horizontal scanning periods and it is the same with regard to reduction of power consumption as the above-described embodiment.

5. Fourth Modification Example

In the third modification example, the order in which the analog switches within the same group are turned on within the horizontal scanning period is fixed to A switch ➔B switch ➔C switch, as illustrated in the timing charts of the switching control signals GSa, GSb and GSc shown in FIGS. 14D to 14F, but this order may also be changed every horizontal scanning period. That is to say, it is possible to change, for example every horizontal scanning period, the order in which the three video signal lines Ls in one group are connected to one of the output terminals $TS_j$ of the video signal line driving circuit 300.

Figure 15A:
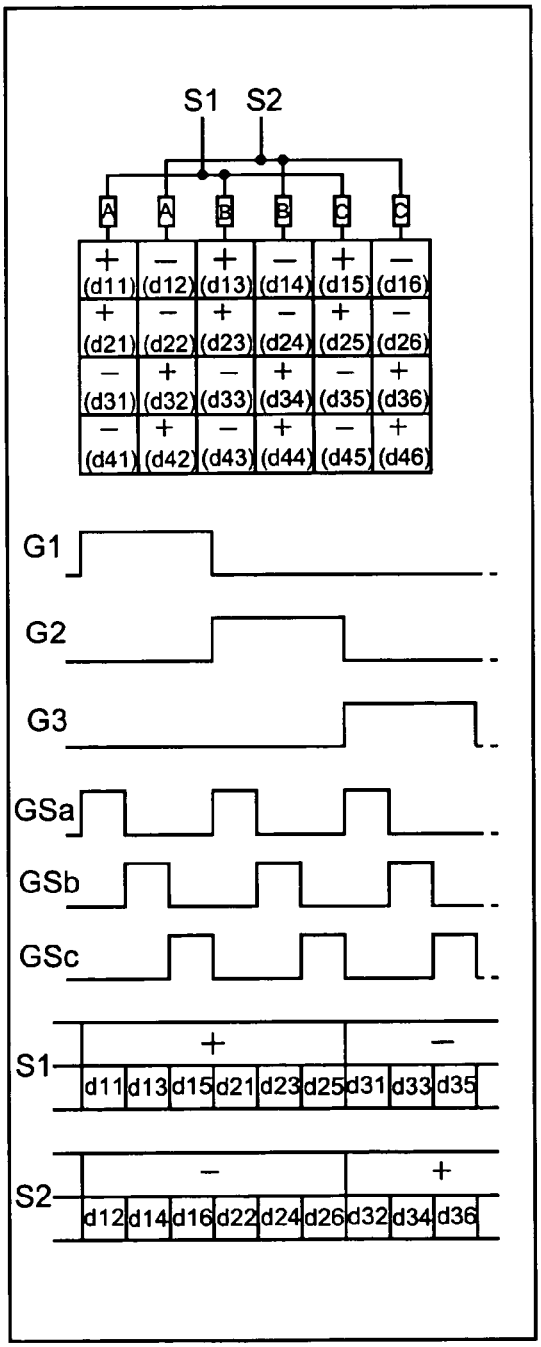
FIG. 15A shows a diagram illustrating the configuration of the connection switching circuit and the polarity pattern for the case that the two-line dot-inversion driving scheme is employed in the third modification example, as well as the timing charts corresponding to this diagram.
Figure 15B:
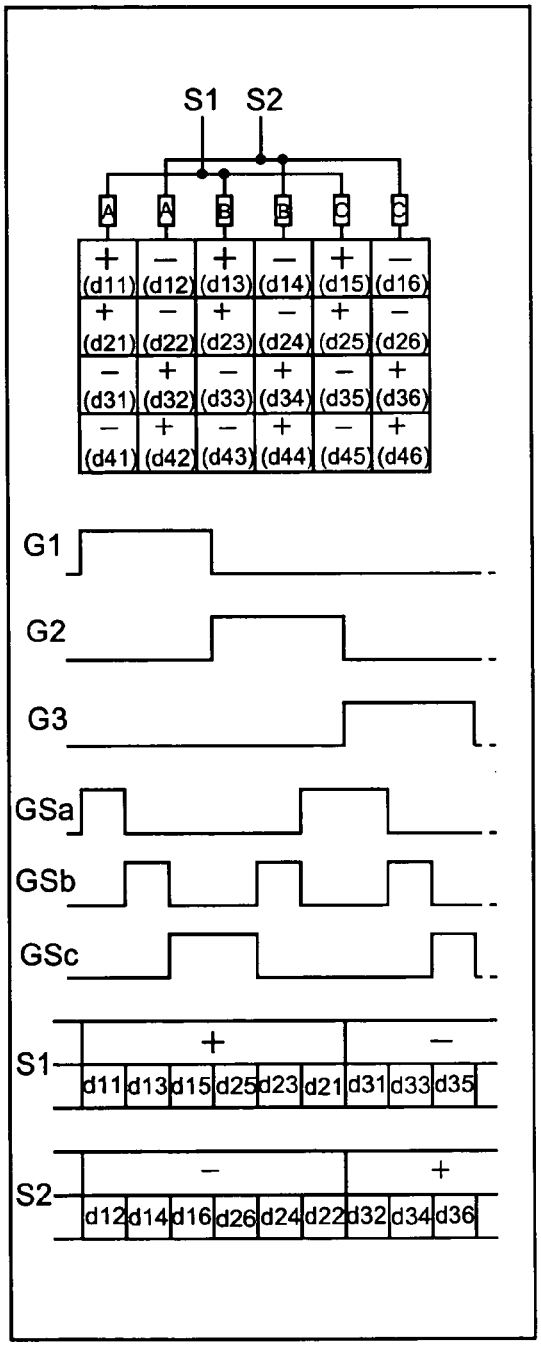
FIG. 15B shows a diagram illustrating the configuration of the connection switching circuit and the polarity pattern for the case that the two-line dot-inversion driving scheme is employed in a fourth modification example, as well as the timing charts corresponding to this diagram.

FIG. 15A is a diagram showing the configuration and the polarity pattern of the third modification example in which the order in which the analog switches in one group are turned on is fixed, as well as the timing charts corresponding to this diagram. FIG. 15B is a diagram showing the configuration and the polarity pattern of this fourth modification example in which the order in which the analog switches in the same group are turned on is changed every horizontal scanning period, as well as the timing charts corresponding to this diagram. In this modification example, the order in which the analog switches within the same group are turned on is A switch ➔B switch ➔C switch for a given horizontal scanning period, and changes to C switch ➔B switch ➔A switch in the next horizontal scanning period, in accordance with the switching control signals GSa, GSb and GSc shown in FIG. 15B. FIG. 15B thus shows the timing charts of the video signals $S_1$ and $S_2$ from the video signal line driving circuit 300 for the case that the order of the connection switching of the video signal lines Ls of the same group is changed every horizontal scanning period.

As can be seen from these timing charts, even when the order of the connection switching of the video signal lines in the same group is changed as in this modification example, in the case of the two-line dot-inversion driving scheme for example, the switching period of the voltage polarity of the video signals $S_1$ and $S_2$ is two horizontal scanning periods, and compared to the case that the order of the connection switching of the video signal lines in the same group is fixed as in FIG. 15A, there is no particular disadvantage with regard to power consumption. On the other hand, with this modification example, the order of the connection switching of the video signal lines Ls in the same group is changed every horizontal scanning period, so that brightness irregularities in the displayed image due to the influence of parasitic capacitances or the like between the pixel electrodes Ep of the pixel formation portions Px and the neighboring video signal lines Ls are dispersed, and the effect is attained that those brightness irregularities are made non-conspicuous (effect of suppressing brightness irregularities).

6. Other Modification Examples

In the above-described embodiment and modification examples, the connection switching circuits 502 to 504 are formed on the liquid crystal panel substrate, but there is no limitation to this, and they may also be included within an IC chip realizing the video signal line driving circuit 300, for example.

While the invention has been described in detail, the foregoing description is in all aspects illustrative and not restrictive. It is understood that numerous other modifications and variations can be devised without departing from the scope of the invention.

What is claimed is:

1. A display device, comprising:

a plurality of pixel formation portions for forming an image to be displayed;

a plurality of video signal lines for transmitting a plurality of video signals representing the image to the plurality of pixel formation portions;

a video signal line driving circuit that has a plurality of output terminals respectively corresponding to a plurality of video signal line groups made by grouping the plurality of video signal lines into groups of two or more video signal lines, for outputting, by time division, from each of the output terminals the video signals to be transmitted by the video signal line group corresponding to that output terminal;

a plurality of scanning signal lines intersecting with the plurality of video signal lines; and a scanning signal line driving circuit for respectively applying to the plurality of scanning signal lines a plurality of scanning signals for selectively driving the plurality of scanning signal lines;

a connection switching circuit for connecting each of the output terminals of the video signal line driving circuit to one of the video signal lines in the corresponding video signal line group, and switching the video signal line to which each of the output terminals is connected within the corresponding video signal line group in accordance with said time division;

wherein the plurality of pixel formation portions are arranged in a matrix, in correspondence to the intersections between the plurality of video signal lines and the plurality of scanning signal lines;

wherein each of the pixel formation portions comprises:

a switching element that is turned on and off by a scanning signal applied by the scanning signal line driving circuit to the scanning signal line passing through the corresponding intersection;

a pixel electrode connected via the switching element to the video signal line that passes through the corresponding intersection; and an opposing electrode that is shared by the plurality of pixel formation portions, and that is disposed such that a predetermined capacitance is formed between the opposing electrode and the pixel electrode;

wherein the connection switching circuit connects, by time division, each of the output terminals of the video signal line driving circuit to the video signal lines within the corresponding video signal line group from the time when one scanning signal line is selected by the scanning signal line driving circuit and until another scanning signal line is selected;

wherein each of the plurality of video signal line groups is made of a plurality of video signal lines that are spaced apart by an odd number of video signal lines so that first and second video signal lines of a given group are spaced apart from one another by at least one video signal line of a different group;

wherein the video signal line driving circuit outputs the plurality of the video signals such that voltages of different polarities are applied to neighboring video signal lines of the plurality of video signal lines; and wherein the connection switching circuit changes a switching order of the video signal lines to be connected to each of the output terminals of the video signal line driving circuit in accordance with a switching of the scanning signal line selected by the scanning signal line driving circuit.

2. The display device according to claim 1, wherein every time the scanning signal line selected by the scanning signal line driving circuit is switched for a predetermined number of times of two or greater, the video signal line driving circuit inverts a voltage polarity of the video signal outputted from each of the output terminals, taking the opposing electrode as reference potential.

3. The display device of claim 1, wherein at least two switches are provided between each video signal line in a given one of the groups.

4. A method for driving an active matrix-type display device comprising a plurality of video signal lines for transmitting a plurality of video signals representing an image to be displayed; a plurality of scanning signal lines intersecting with the plurality of video signal lines; a video signal line driving circuit having a plurality of output terminals respectively corresponding to a plurality of video signal line groups made by grouping the plurality of video signal lines into groups of two or more video signal lines; and a plurality of pixel formation portions that are arranged in a matrix, in correspondence to the intersections between the plurality of video signal lines and the plurality of scanning signal lines;

the method comprising:

a scanning signal line driving step of selectively driving the plurality of scanning signal lines;

a video signal output step of outputting, by time division, from each of the output terminals the video signals to be transmitted by the video signal line group corresponding to that output terminal; and a connection switching step of connecting each of the output terminals to one of the video signal lines in the corresponding video signal line group, and switching the video signal line to which each of the output terminals is connected within the corresponding video signal line group in accordance with said time division;

wherein each of the plurality of video signal line groups is made of a plurality of video signal lines that are spaced apart by an odd number of video signal lines so that first and second video signal lines of a given group are spaced apart from one another by at least one video signal line of a different group;

wherein in the video signal output step the plurality of the video signals are outputted such that voltages of different polarities are applied to neighboring video signal lines of the plurality of video signal lines; and wherein in the connection switching step, a switching order of the video signal lines to be connected to each of the output terminals of the video signal line driving circuit is changed in accordance with a switching of the scanning signal line selected in the scanning signal line driving step.

5. The method according to claim 4, wherein in the video signal output step, every time the scanning signal line selected in the scanning signal line driving step is switched for a predetermined number of times of two or greater, a voltage polarity of the video signal outputted from each of the output terminals is inverted.

6. The method of claim 4, wherein at least two switches are provided between each video signal line in a given one of the groups.

* * * * *